US008756054B2

(12) United States Patent
Kovesi et al.

(10) Patent No.: US 8,756,054 B2
(45) Date of Patent: Jun. 17, 2014

(54) METHOD FOR TRAINED DISCRIMINATION AND ATTENUATION OF ECHOES OF A DIGITAL SIGNAL IN A DECODER AND CORRESPONDING DEVICE

(75) Inventors: Balazs Kovesi, Lannion (FR); Alain Le Guyader, Lannion (FR)

(73) Assignee: France Telecom, Paris (FR)

( * ) Notice: Subject to any disclaimer, the term of this patent is extended or adjusted under 35 U.S.C. 154(b) by 1587 days.

(21) Appl. No.: 12/224,137

(22) PCT Filed: Feb. 13, 2007

(86) PCT No.: PCT/FR2007/050786

§ 371 (c)(1),
(2), (4) Date: Oct. 17, 2008

(87) PCT Pub. No.: WO2007/096552

PCT Pub. Date: Aug. 30, 2007

(65) Prior Publication Data

US 2009/0313009 A1 Dec. 17, 2009

(30) Foreign Application Priority Data

Feb. 20, 2006 (FR) ..... 06 01466

(51) Int. Cl.
*G10L 19/02* (2013.01)
*G10L 21/00* (2013.01)

(52) U.S. Cl.
USPC ..... 704/203; 704/205

(58) Field of Classification Search
USPC ..... 704/203, 205, 219, 226–228
See application file for complete search history.

(56) References Cited

U.S. PATENT DOCUMENTS

2005/0055116 A1 * 3/2005 Isaka et al. ..... 700/94

FOREIGN PATENT DOCUMENTS

| | | | |
|---|---|---|---|
| EP | 1 335 353 | A | 8/2003 |
| EP | 1 335 353 | A2 * | 8/2003 |
| WO | WO 2006/114368 | A | 11/2006 |

* cited by examiner

*Primary Examiner* — Angela A Armstrong
(74) *Attorney, Agent, or Firm* — Knobbe Martens Olson & Bear LLP

(57) ABSTRACT

The invention concerns a method for trained discrimination and attenuation of echoes of a digital audio signal generated from a transform coding, which consists, for each current frame of the signal. In comparing (A) in real time, in at least one frequency band a variable derived from one characteristic of the echo generating signal with that of a non-echo generating signal at a threshold value, and deducing therefrom (B) the existence or non-existence (C) of an echo derived from the transform coding, discriminating the existence of the echo and defining (D) a false alarm zone in the high-energy parts of the digital audio signal, determining an initial processing and attenuating the echoes (E) in the parts complementary to the low-energy false alarm zone and inhibiting (F) the attenuation of echoes in the false alarm zone. The invention is applicable to the technology of coders/decoders in particular hierarchical coders/decoders.

13 Claims, 20 Drawing Sheets

$L = 160; K_2 = 4; N_2 = L / K_2 = 40; C = 80; S = 8$

No great energy variation; $max_{en} / min_{en} < S$ $ind_1 = 0$
$ind_2 = L-1 = 159$ "false alarm" zone detected in the current frame:
Whole frame, sample, $X_{rec}(0,...,159)$

METHOD FOR TRAINED DISCRIMINATION AND ATTENUATION OF ECHOES OF A DIGITAL SIGNAL IN A DECODER AND CORRESPONDING DEVICE

The invention relates to a method and a device for safe discrimination and attenuation of the echoes of a digital signal in a decoder and a corresponding device.

For the transportation of the digital audio signals over the transmission networks, whether fixed, mobile or broadcast networks, or for the storage of the signals, compression processes are used that implement encoding systems of the time encoding type, possibly predictive, or of the so-called transform encoding type.

The method and the device that are the subject of the invention are applicable to the compression of the sound signals, in particular the coded digital audio signals, the frames of which are the source of sound increases and/or reductions generated by musical instruments, voice signals comprising plosive syllables and, in particular, multilayer decoder devices including decoders in the time domain (predictive or other) and inverse frequency transform decoders.

FIG. 1 represents, by way of illustration, a schematic diagram of the encoding and decoding of a digital audio signal by transform and addition/overlap according to the prior art.

For a more detailed description of the abovementioned encoding and decoding processes, reference can, for example, be made to the introduction to the description of the French patent application 05 07471 filed on 12 Jul. 2005 by the applicant.

Some musical sounds, such as percussions and certain speech sequences such as plosive syllables, are characterized by extremely abrupt attacks that are reflected in very rapid transitions in a very strong variation in the dynamic range of the sampled signal in the space of a few samples (from the sample 410 in FIG. 1).

The subdivision into successive blocks of samples applied by transform encoding is totally independent of the sound signal and the transitions therefore appear at any point in the analysis window. Now, in transform encoding, the noise is distributed timewise uniformly over the entire duration of the sampled block of length 2L. This reflected in the appearance of pre-echoes prior to the transition and post-echoes after the transition.

The noise level is less than that of the signal for the high-energy samples, immediately following the transition, but it is greater than that of the signal for the lower-energy samples, notably over the part preceding the transition (samples 160-410 in FIG. 1). For the abovementioned part, the signal-to-noise ratio is very negative and the resultant degradation, designated pre-echoes, can appear very annoying.

It can be seen in FIG. 1 that the pre-echo affects the frame preceding the transition and the frame in which the transition occurs.

In practice, the human ear applies a fairly limited pre-masking, of the order of a few milliseconds, before the physiological transmission of the attack.

The noise produced, or the pre-echo, is audible when the duration of the pre-echo is greater than the pre-masking duration.

The human ear also applies a post-masking of a longer duration, 5 to 60 milliseconds, on the transition from high-energy sequences to low-energy sequences. The rate or level of annoyance that is acceptable for the post-echoes is therefore greater than for the pre-echoes.

The more critical pre-echo phenomenon is all the more annoying as the length of the blocks in terms of number of samples increases. Now, in transform encoding, it is necessary to have an accurate resolution of the most significant frequency zones. At fixed sample frequency and at fixed bit rate, if the number of points of the window is increased, there will be more bits available for encoding the frequency lines deemed useful by the psycho-acoustic model, hence the advantage of using blocks of long length. When an encoding process, AAC (Advanced Audio Coding) for example, is implemented, a window of long length contains a fixed number of samples, 2048, i.e. over a duration of 64 ms if a sampling frequency of 32 kHz. The encoders used for the conversational applications often use a window with a duration of 40 ms at 16 kHz and a frame renewal duration of 20 ms.

In order to reduce the abovementioned annoying effect of the pre-echo phenomenon, and to a lesser extent the post-echo phenomenon, various solutions have hitherto been proposed.

A first solution entails applying a filtering. In the zone preceding the transmission due to the attack, the reconstituted signal is in fact made up of the original signal and the quantization noise overlaid on the signal.

A corresponding filtering technique has been described in the article entitled High Quality Audio Transform Coding at 64 kbits, IEEE Trans on Communications Vol 42 No. 11, November 1994, published by Y. Mahieux and J. P. Petit.

Implementing such a filtering entails knowing parameters, some of which are estimated on the decoder from noise-affected samples. However, information such as the energy of the original signal can be known only to the encoder and must consequently be transmitted. When the received block contains an abrupt variation in the dynamic range, the filtering processing is applied to it.

The abovementioned filtering process does not make it possible to retrieve the original signal, but does produce a strong reduction in the pre-echoes. However, it requires the additional auxiliary parameters to be transmitted to the decoder.

A second solution involves reducing the pre-echoes by a dynamic switching of the windows.

Such a technique has been described in the U.S. Pat. No. 5,214,742 granted to B. Edler. This solution has been the subject of applications in various audio encoding solutions according to international standards.

According to this solution, because of the fact that the time and frequency resolution of the signals depend strongly on the length of the coding window, the frequency coders switch between long windows (2048 samples, for example), for stationary signals, and short windows (256 samples for example) for signals with widely varying dynamic range or transient signals. This adaptation is performed in the AAC module, the decision being taken frame by frame on the encoder.

One of the drawbacks of this second solution is that it includes an additional delay of the order of N/2 samples because of the fact that if a transition begins in the next window, it is essential to be able to prepare the transition and to switch to a transition window that makes it possible to retain the perfect reconstruction.

The reduction of the echoes can, however, be facilitated in the hierarchical encoders when the decoder comprises several time decoding stages, possibly predictive, and transform decoding stages. In this case, the time decoding stages can be used to detect echo. An example of decoding of this type is described in the US patent application 2003/0154074 by K. Kikuiri et al.

The method known from the prior art described by the abovementioned patent application consists in performing a detection of the pre-echoes exclusively based on the decoded CELP basic core signal, CELP standing for Code Excited Linear Prediction.

Such a method does not make it possible to provide, for this reason, a pre-echo reduction processing based on the attached information and in synchronism with the reconstructed frames from the time decoder and from the transform decoder.

The abovementioned French patent application 05 07471 makes it possible to discriminate the presence of the echoes and attenuate the echoes of a digital audio signal generated by multi-layer hierarchical encoding from a transform encoding, which generates echoes, and a time encoding, which does not generate echoes. In this patent application, in the decoding, and for each current frame of the digital audio signal, the value of the ratio of the amplitude of the signal obtained from an echo-generating decoding to the amplitude of the signal obtained from a non-echo-generating decoding is compared to a threshold value, in real time. If the value of this ratio is greater than or equal to this threshold value, it can be concluded that an echo deriving from the transform encoding exists in the current frame. Otherwise, the value of this ratio being less than this threshold value, it can be concluded that an echo deriving from the transform encoding does not exist in this current frame.

This method is described by FIG. 2*a* and FIG. 2*b* corresponding to FIGS. 3*a* and 3*b* in the abovementioned patent application. Hereinafter in the introduction to the description of the present patent application, the figure numbers between parentheses designate the figure numbers in the French patent application 05 07471 introduced into the present application for reference purposes.

FIG. 2*a* describes a hierarchical decoder comprising a plurality of non-echo-generating decoders, called "predictive decoding layer i", and a plurality of transform decoders called "transform decoding layer j".

FIG. 2*b* (FIG. 3*b*) describes the device 1 for discriminating echoes with, as input, the decoded signal deriving from the time decoder and the one deriving from the transform decoder. The output of the echo device controls the echo attenuating device 2 by attenuating the decoded signal at the addition/overlap output.

FIG. 2*c* (FIG. 3*c*) indicates how to calculate the time envelopes of the signals deriving respectively from the time decoder and from the transform decoder, and the echo presence flag.

FIG. 2*d* (FIG. 3*e*) shows how the attenuation of the echoes is performed over the echo presence duration by multiplication of the addition/overlap output signal by a gain g(k) equal to the ratio of the envelope of the time signal to that of the transform-decoded signal.

$$g(k)=\mathrm{Min}(Env_{Pi}(k)/Env_{Tj}(k),1)$$

In this figure, when the value of POS is zero, the pre-echo processing is performed over the entire frame.

FIG. 2*e* (FIG. 11) describes the principle of the discrimination of the echoes in a multi-layer system where the discrimination of the echoes and their attenuation is performed in a non-limiting way in two frequency sub-bands.

In this example, the signal filtering operations are performed either by time filtering on the time signal $x_{Pi}$ (n), or by filtering in the MDCT (Modified Discrete Cosine Transform) frequency domain, performed by transformation of the time signal into MDCT coefficients, then manipulation of the MDCT coefficients (setting of the MDCT coefficients to zero, addition, replacement, etc.) and finally inverse MDCT transform followed by addition/overlap for each of the sub-bands.

The method and the device described by the abovementioned French patent application 05 07471 provides a solution to the drawbacks of the prior art mentioned previously.

In the solution described in the French patent application 05 07471, to remedy the erroneous triggering of the echo attenuation device, a procedure for predicting the triggering of the echo attenuation device is used on the encoder.

More specifically, since the encoder has the signal to be transform-encoded, the discrimination of the echoes on the non-quantized signal is performed on the encoder, and, since the encoder is not subject to the pre-echoes, any triggerings can be guaranteed to be erroneous. The echo is detected on the encoder, and if there is an abnormal detection, a flag is then transmitted in the frame to inhibit the attenuation of the echo on the decoder.

The object of the present invention is to avoid the cases of erroneous triggering of the echo attenuation device, in the absence, on the one hand, of transmission of a specific auxiliary indication from the encoder, and, on the other hand, of the introduction of additional complexity in the encoding.

Another object of the invention is, furthermore, in case of non-transmission of the false-alarm indication from the encoder, to enable the attenuation of the echoes to be inhibited in synchronism with the appearance of the attack, which cannot be done in the prior art devices, because the time encoder generally does not react instantaneously to the attack.

Another object of the present invention is, furthermore, to avoid the erroneous triggering of the echo attenuation device when the signal deriving from the transform decoder has a constant dynamic range, the echo attenuation device not needing to be activated, because there is no attack, unlike the devices of the prior art, in which, when the signal decoded by the time decoder is weak relative to the signal decoded by the transform decoder, the echo attenuation device is triggered.

Another object of the present invention is to provide for an implementation in the case where a low data rate is allocated to the time encoder, which, consequently, cannot correctly encode all the input signals.

One example that can be cited is the case of certain time encoders of the prior art operating in a reduced frequency band of the signal, 4000 to 7000 Hz, and which cannot correctly encode the sinusoids present in this band. The signal at the time encoder output is then weak and the echo attenuation is wrongly activated which produces a strong encoding degradation.

Another object of the present invention is also to provide for the implementation of a method and a device for the safe discrimination and attenuation of the echoes of a digital signal in a multi-layer decoder that makes it possible to prevent the attenuation of post-echoes from being wrongly inhibited when the attack lies in the preceding frame.

The method for discriminating and attenuating the echoes of a digital audio signal generated from a transform encoding, which generates echoes, the subject of the invention, is noteworthy in that it includes at least in the decoding, for each current frame of this digital audio signal, the steps consisting in discriminating a low-energy zone preceding a transition to a high-energy zone, defining a false-alarm zone corresponding to the non-discriminated zones of the current frame, determining an initial processing of the echoes with attenuation gain values, attenuating the echoes according to the initial processing of the echoes in the low-energy discriminated zones of the current frame, inhibiting the attenuation of the echoes of the initial processing in the false-alarm zone.

The method that is the subject of the invention that makes it possible to eliminate the echoes, pre-echoes and post-echoes, without introducing degradation on the high-energy signal generated by an attack.

Hereinafter, the following notation is used in reference to FIG. 2*f* and the following equation:

$$x_{rec}(n)=h(n+L)x_{prev}(N+L)+h(n)x_{cur}(n) \text{ for } n\in[0, L-1]$$

In a transform encoder, the reconstructed signal of the current frame ($x_{rec}(n)$, n=0 to L−1) is obtained by weighted addition of the second part of the output of the inverse MDCT of the MDCT coefficients of the preceding frame ($x_{prev}(n)$, n=L to 2L−1) and the first part of the output of the inverse MDCT of the MDCT coefficients of the current frame ($x_{cur}(n)$, n=0 to L−1). The second part of the output of the inverse MDCT of the MDCT coefficients of the current frame ($x_{cur}(n)$ n=L to 2L−1), will be kept in memory to be used to obtain the reconstructed signal of the next frame. To simplify, hereinafter, the terms "first part of the current frame", "second part of the current frame", "reconstructed signal of the current frame" will be used. In the next frame, the second part of the current frame therefore becomes the second part of the preceding frame.

In particular, for an attack situated in the current frame, in the first or second part, the method that is the subject of the invention consists in generating a concatenated signal, from the reconstructed signal of the current frame and from the signal of the second part of the current frame, dividing up this concatenated signal into an even number of sub-blocks of samples of determined length, calculating the energy of the signal of each of the sub-blocks of determined length, calculating a first index representative of the rank of the maximum energy sample and a second index representative of the last high-energy sample, calculating the minimum energy over a number that is half the even number of sub-blocks of the first sub-blocks of the digital audio signal and, when the ratio of the maximum energy to the minimum energy is greater than a determined threshold value, a risk of pre-echoes being revealed in the only low-energy part of the signal, inhibiting any attenuation action on the high-energy samples of rank between the first and the second index.

The determination of the first and the second indices makes it possible to define between the latter a false-alarm range corresponding to the high-energy signal in which the attenuation of the echoes, pointless or damaging to the signal, must be eliminated.

The device for discriminating and attenuating the echoes of a digital audio signal generated by a multi-layer hierarchical encoder, in a decoder, the subject of the invention, this decoder comprising at least one time decoder, which does not generate echoes, and at least one transform decoder, which can reveal echoes, is noteworthy in that it comprises at least on a time decoder and a transform decoder, means of discriminating a low-energy zone preceding a transition to a high-energy zone, means of defining a false-alarm zone corresponding to the non-discriminated zones of the current frame, means of determining an initial processing of the echoes with attenuation gain values, means of attenuating the echoes according to the initial processing of the echoes applied to the low-energy discriminated zones of the current frame and means of inhibiting the attenuation of the echoes of the initial processing applied to the false-alarm zone.

They will be better understood from reading the description and studying the drawings below in which, apart from FIG. 1 and FIGS. 2*a* to 2*e* which relate to the prior art, as described in the French patent application 05 07471, and FIG. 2*f* relating to the prior art:

DETAILED DESCRIPTION OF THE PREFERRED EMBODIMENT

A more detailed description of the method that is the subject of the invention will now be given in association with FIGS. 2*b* and 3*a*.

The method that is the subject of the invention makes it possible to discriminate the echoes of a digital audio signal in decoding, when this digital audio signal is generated by multi-layer hierarchical encoding from a transform encoding and predictive encoding.

Figure 1:
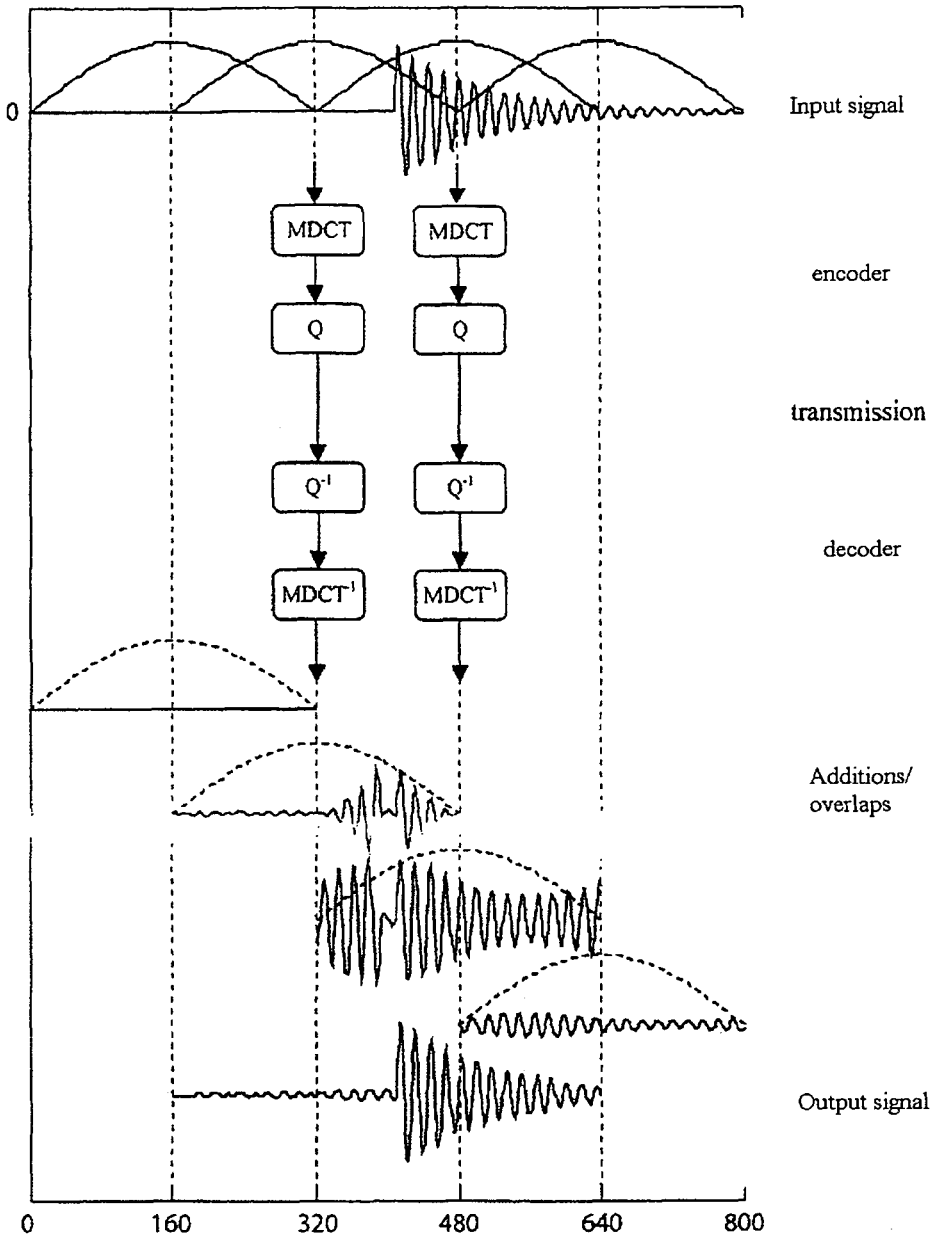
FIG. 1 represents, by way of illustration, a schematic diagram of the encoding and decoding of a digital audio signal by transform and addition/overlap.
Figure 2A:
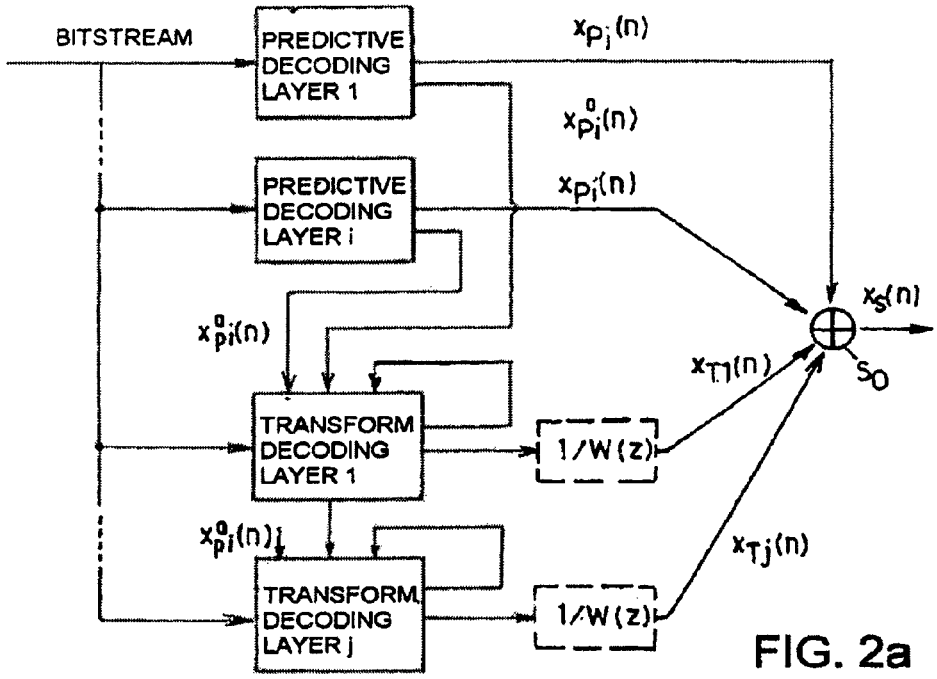
FIG. 2*a* describes a hierarchical decoder comprising a plurality of non-echo-generating decoders and a plurality of transform decoders.
Figure 2B:
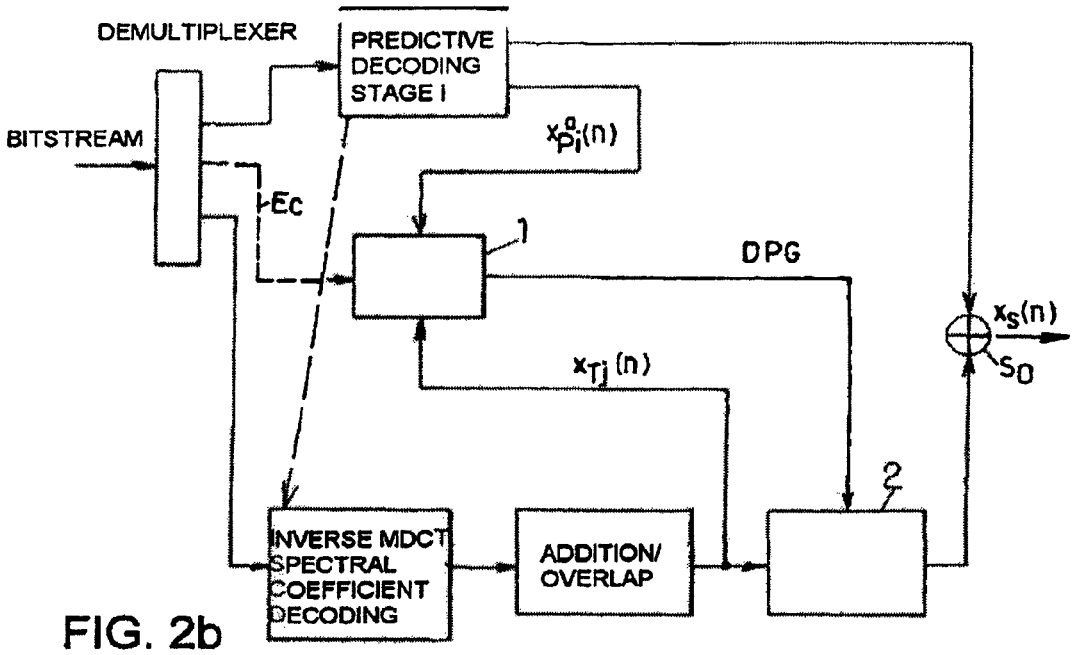
FIG. 2*b* describes a device for discriminating echoes with, as input, the decoded signal deriving from the time decoder and the one deriving from the transform decoder.
Figure 2C:
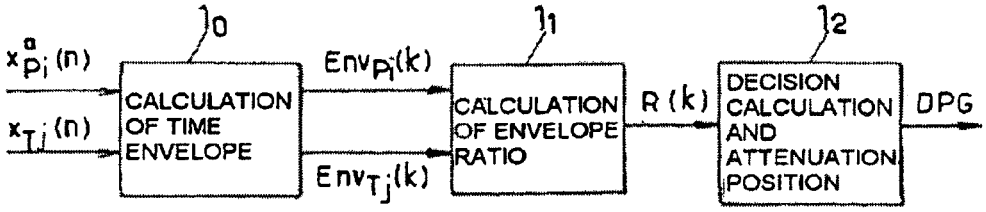
FIG. 2*c* indicates how to calculate the time envelopes of the signals deriving respectively from the time decoder and from the transform decoder, and the echo presence flag.
Figure 2D:
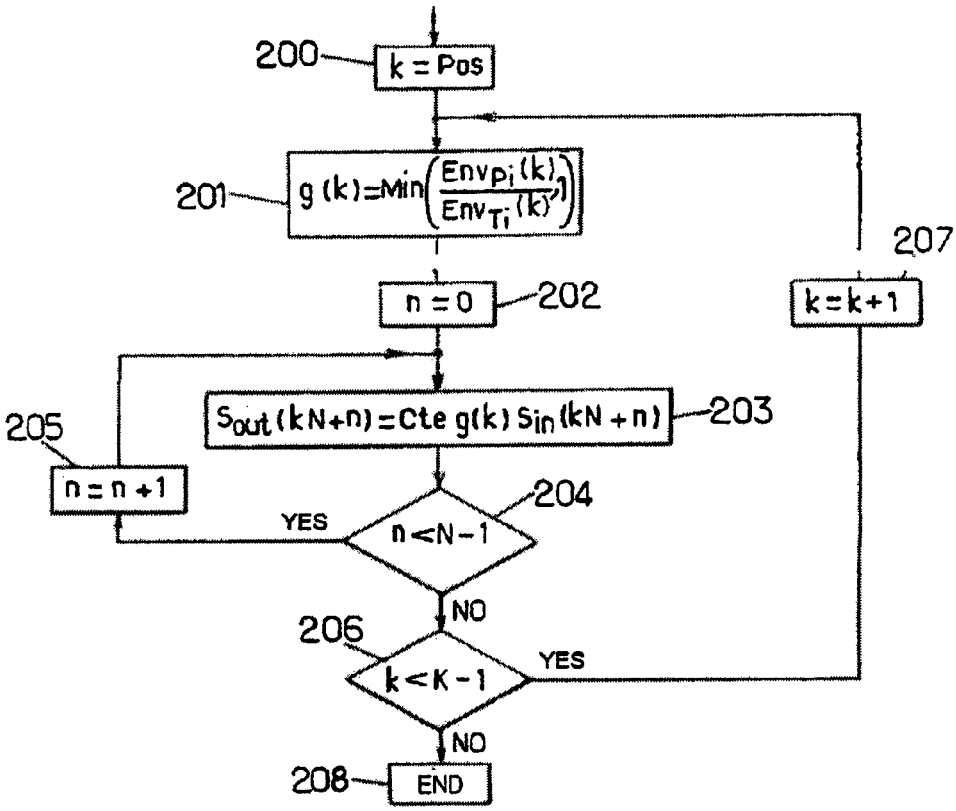
FIG. 2*d* shows how the attenuation of the echoes is performed over the echo presence duration by multiplication of the addition/overlap output signal by a gain g(k) equal to the ratio of the envelope of the time signal to that of the transform-decoded signal.
Figure 2E:
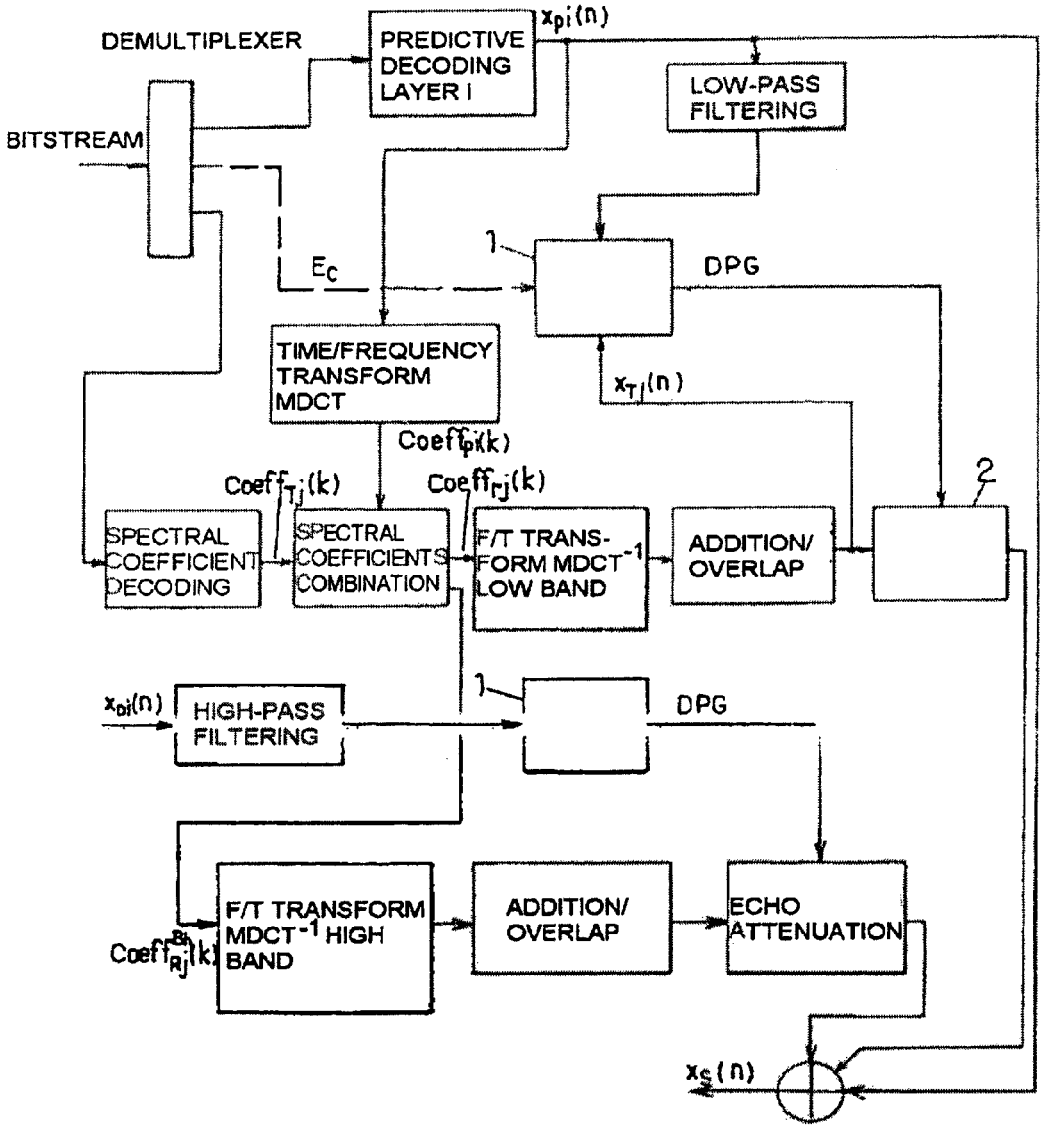
FIG. 2*e* describes the principle of the discrimination of the echoes in a multi-layer system where the discrimination of the echoes and their attenuation is performed in a non-limiting way in two frequency sub-bands.

Referring to FIG. 2*b:*

- $x_{Tj}(n)$ designates the signal delivered by an inverse transform decoding delivered by a layer j transform decoder of a multi-layer hierarchical decoder;
- $x_{Pi}^{a}(n)$ designates the signal delivered by a predictive decoding performed by a layer i predictive decoder in the corresponding hierarchical decoder. The signal $x_{Pi}^{a}(n)$ can be either the output signal from the predictive decoder that does not generate echo or a filtered version of this signal or a representation of the short-term energy of this signal.

Figure 3A:
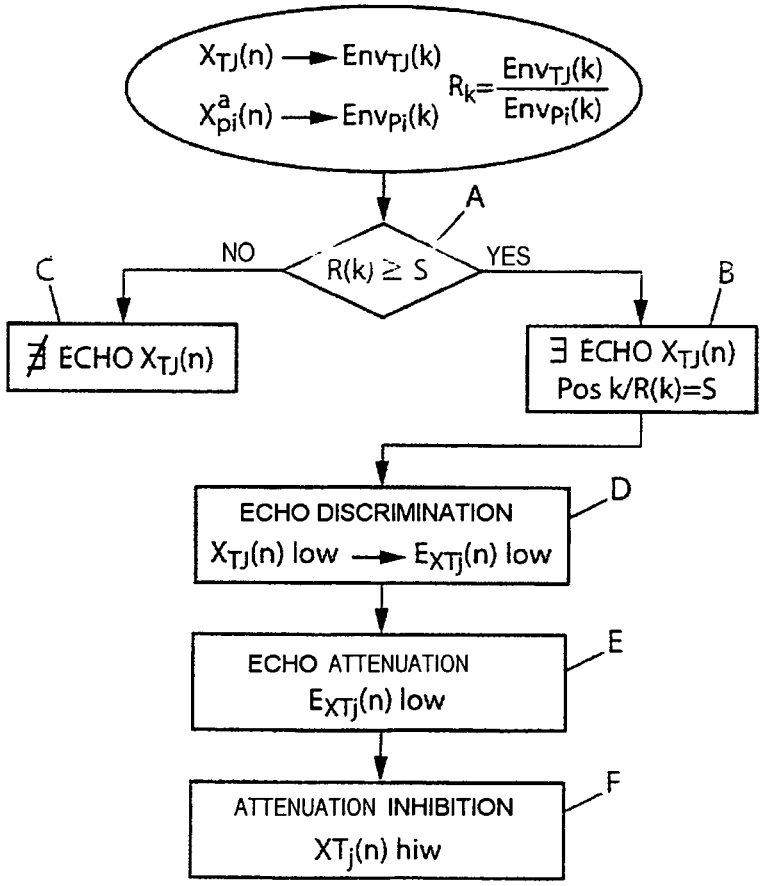
FIG. 3*a* represents, by way of illustration, a general flow diagram of the steps for implementing the method that is the subject of the invention.

Referring to FIG. 2*a*, FIG. 2*b* and FIG. 3*a*, it should be indicated that the method that is the subject of the invention consists, in a step A, in comparing in real time the value of the ratio R(k) of the amplitude of the signal deriving from a decoding that generates echoes to the amplitude of the signal deriving from a decoding that does not generate echoes to a threshold value S.

In FIG. 3*a*, the amplitude of the signal deriving from a decoding that generates echo is denoted $Env_{Tj}(k)$ and the amplitude of this signal deriving from a decoding that does not generate echo is denoted $Env_{Pi}(k)$.

Referring to the indicated notation, it will be understood, in particular, that the amplitude of the signal deriving from a decoding that generates echo and the amplitude of the signal deriving from a decoding that does not generate echo can advantageously be represented by the envelope signal of the echo generating decoding signal $x_{Tj}(n)$, respectively of the signal deriving from a non-echo-generating decoding $x_{Pi}^{a}(n)$.

In FIG. 3*a*, the obtaining of the amplitude signal is represented by the relations:

$$x_{Tj}(n) \rightarrow Env_{Tj}(k)$$

$$x_{Pi}^{a}(n) \rightarrow Env_{Pi}(k)$$

Generally, it should be indicated that the amplitude signal of the signal deriving from an echo-generating decoding, respectively of the signal deriving from a non-echo-generating decoding, can be represented not only by the abovementioned envelope signal but also by any signal such as the absolute value, or other, representative of the abovementioned amplitude.

Referring to the same FIG. 3*a*, it should be indicated that the ratio of the amplitude of the signal deriving from an echo-generating decoding to the amplitude of the signal deriving from the non-echo-generating decoding is represented by the relation:

$$R(k) = \frac{Env_{Tj}(k)}{Env_{Pi}(k)} \quad k = 0, K-1$$

Referring to the preceding notations, it should be indicated that the comparison step A of FIG. 3*a* consists in comparing the value of the ratio R(k) to the threshold value S, applying a superiority and equality comparison.

If the value of the abovementioned ratio is greater than or equal to the threshold value S, in positive response to the step A, the abovementioned test then makes it possible to conclude in the step B that an echo deriving from the transform encoding exists in the current frame, this echo then being revealed in the decoding.

The existence of the echo is represented in the step B by the relation:

$$\exists \text{ echo } x_{Tj}(n)$$

Otherwise, in negative response to the test of the step A, if the value of the abovementioned ratio is less than the threshold value S, the test of the step A then makes it possible to conclude, in the step C, that an echo deriving from the transform encoding does not exist in the current frame.

This relation is denoted in the step C by:

$$\nexists \text{ echo } x_{Tj}(n)$$

In a particularly advantageous way, according to the implementation of the method that is the subject of the invention, it should be indicated that the original position of the echo in the current frame is in fact given by the position, in the current frame, of the value of the ratio roughly equal to the threshold value S.

The abovementioned value is given in the step B of FIG. 3*a* by the relation:

$$Pos\ k | R(k) = S$$

As a general rule, regarding the implementation of the test of the step A and, ultimately, of the tests C and B of FIG. 2*b* or 3*a*, in particular of the step B following the step A, it will be understood that the value of the ratio R(k) can be calculated as a smoothed value over the current frame, so as to compare in real time the value of the abovementioned ratio to the threshold value S. When the value of the abovementioned ratio is equal to the value of S, then the original position of the echo is given by the particular value of the rank k of the corresponding sample of the decoding signal in the current frame.

The step B, in the presence of echoes, is followed by a step D consisting in discriminating the existence of echoes in the low-energy digital audio signal parts, denoted $XTj(n)_{low}$. The corresponding echoes are denoted $EXTj(n)_{low}$. Furthermore, the step D makes it possible, from the abovementioned discrimination, to define a false-alarm zone, corresponding to the non-discriminated zones of the current frame.

Following the discrimination in the step D, a step E is performed, which consists in determining an initial processing of the echoes with attenuation gain values and in attenuating the echoes in the low-energy digital audio signal parts. The step E is followed by a step F consisting in inhibiting the attenuation of the echoes in the high-energy digital audio signal parts, denoted $XTj(n)_{hiw}$.

As a general rule, the method that is the subject of the invention can be implemented by performing the discrimination and the attenuation of the echoes in several signal bands with, as a non-limiting example, the case of two frequency bands, the low band [0-4 kHz] and the high band: [4-8 kHz]. In this example, a time/transform multi-layer encoder is implemented in each band of the signal. In the low band, the transform encoder quantizes the difference between the original signal and the decoded CELP signal in the perceptual domain (after filtering by the perceptual filter W(z)), whereas, in the high band, it quantizes the original signal without perceptual filtering and, on decoding, the correctly decoded bands replace the already decoded bands deriving from the MDCT of the time signal supplied by the band extension module. The addition provided by the invention is therefore described for the device of each sub-band.

Figure 3B:
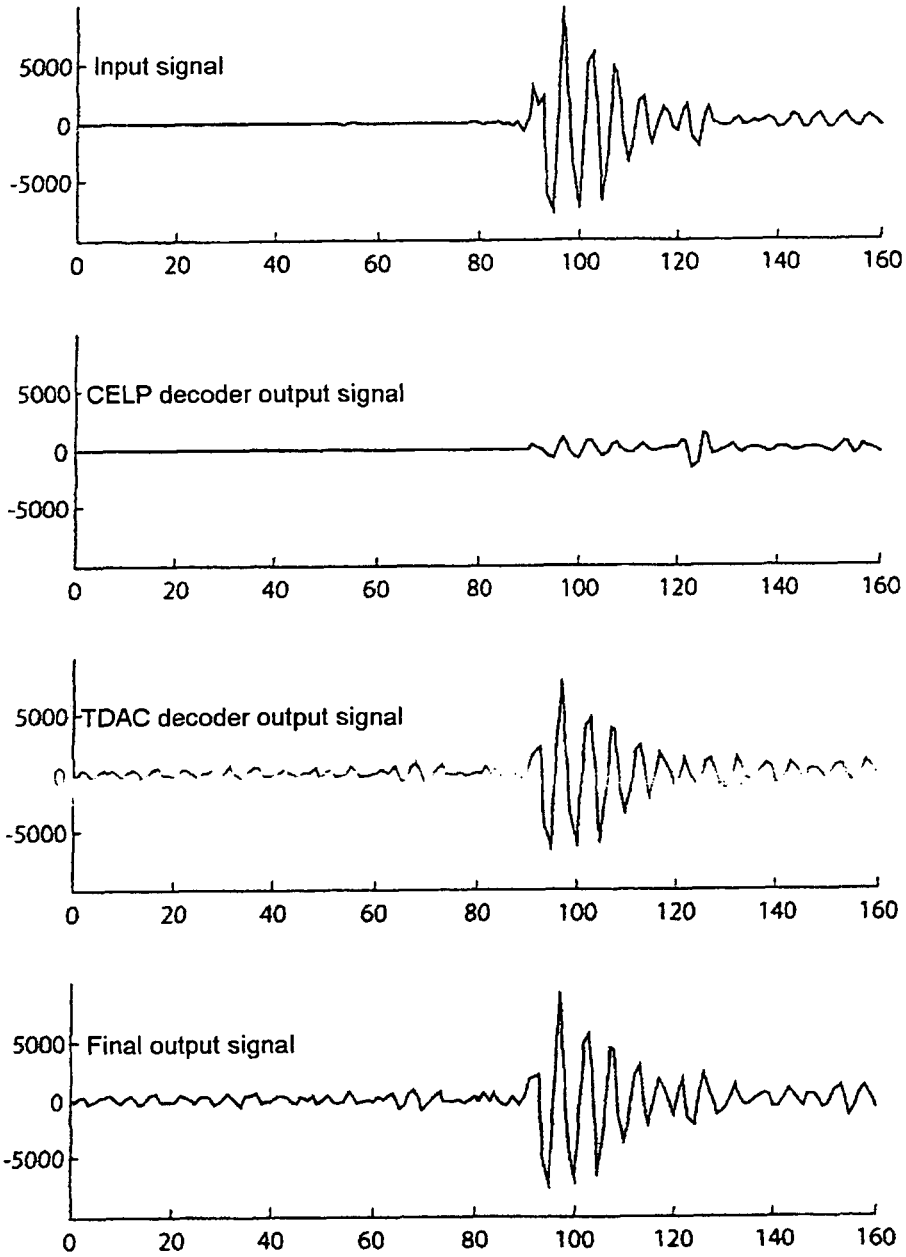
FIG. 3*b* represents a timing diagram of the digital audio signals in a CELP predictive/multi-layer transform encoder of the low band of the signal, in the absence of echo attenuation.

FIG. 3*b* shows the audio signals involved in synthesizing the low band of the signal in a CELP predictive/multi-layer transform decoder of the type of that described by FIG. 2*a*. It can be seen that the predictive/CELP decoding stage does not produce echo, unlike the transform output stage (output signal from the TDAC—Time Domain Aliasing Cancellation—decoder, bank of filters with perfect reconstruction) which is subject to the appearance of echo in the form of a pre-echo between the samples n=0 to n=85. It therefore follows from this that the output stage of the CELP predictive encoder can be used, in combination with the output from the transform decoding stage, to attenuate the echo.

The final output signal resulting from the addition of the decoded CELP signal and of the decoded transform signal is itself also a source of the same echo phenomenon.

Figure 2F:
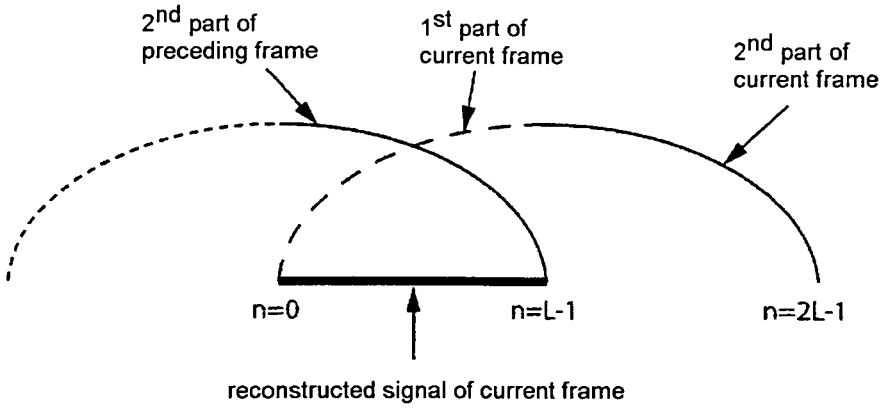
FIG. 2*f* illustrates a process for reconstruction of a frame
Figure 3C:
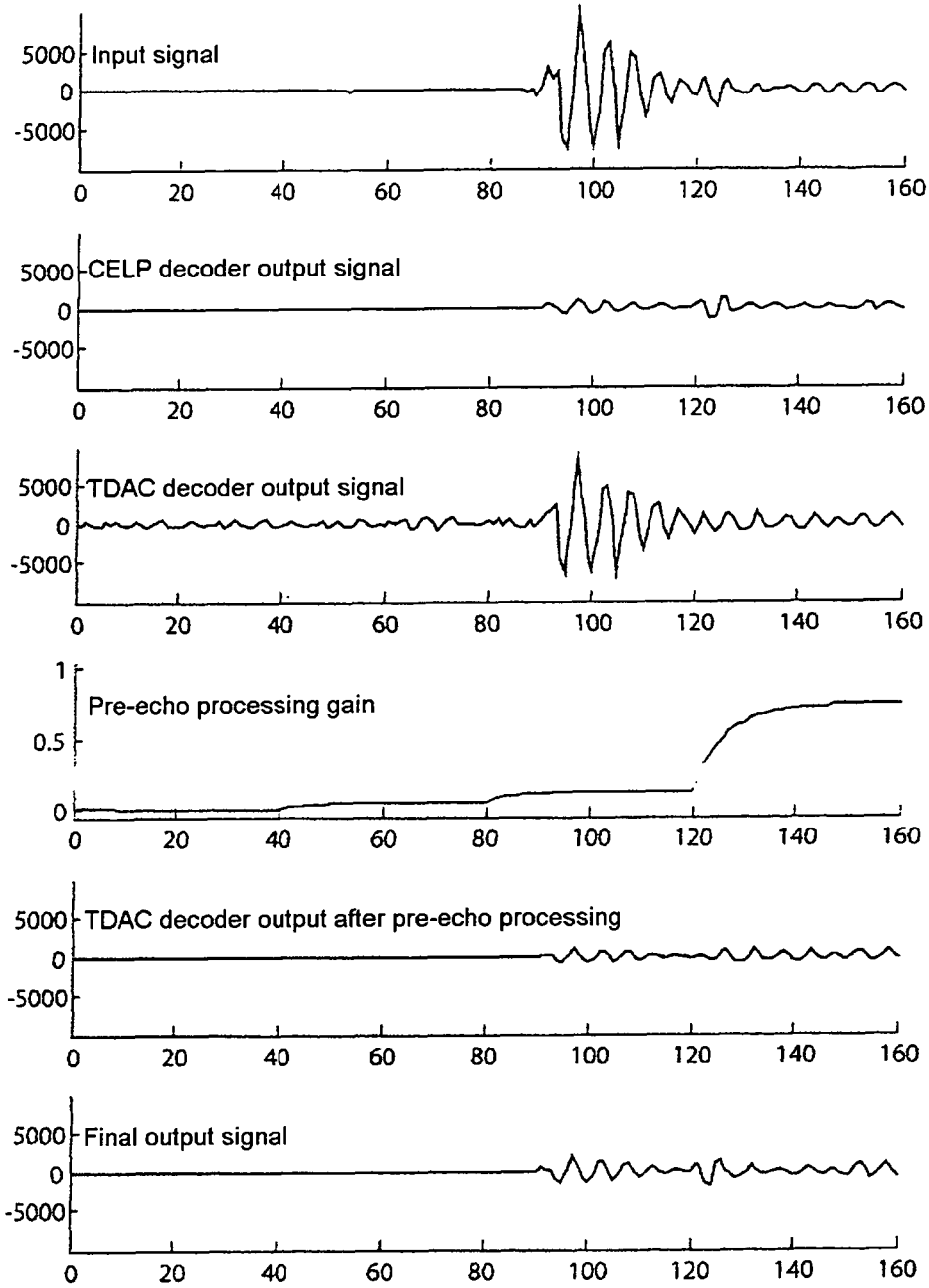
FIG. 3*c* represents a timing diagram of the digital audio signals in a CELP predictive/multi-layer transform encoder in the low band of the signal with echo attenuation of the prior art illustrated by FIG. 2*b;*

When an echo attenuation device of the prior art (for example that of FIG. 2.*b*) is activated, the signals of FIG. 3*c* are obtained. The first three plots represent the same signals as those of FIG. 3*b*. The next three plots represent, respectively:

- the pre-echo processing gain (rectangle 1 in FIG. 2*b*) having a value between 0 and 1.
- the signal output from the transform decoding stage (TDAC decoder output) after pre-echo processing. It will be seen that, while the echo that precedes the attack has been eliminated, the part of the attack deriving from the transform decoder has been wrongly attenuated. One fundamental benefit of the method and the device that are the subject of the invention is to overcome in this drawback.
- the final output signal, the sum of the output signal from the CELP decoder and the output from the TDAC decoder, which presents no pre-echo but the attack of which has almost disappeared, which is reflected in the listening experience in a degradation of the digital audio signal.

Figure 3D:
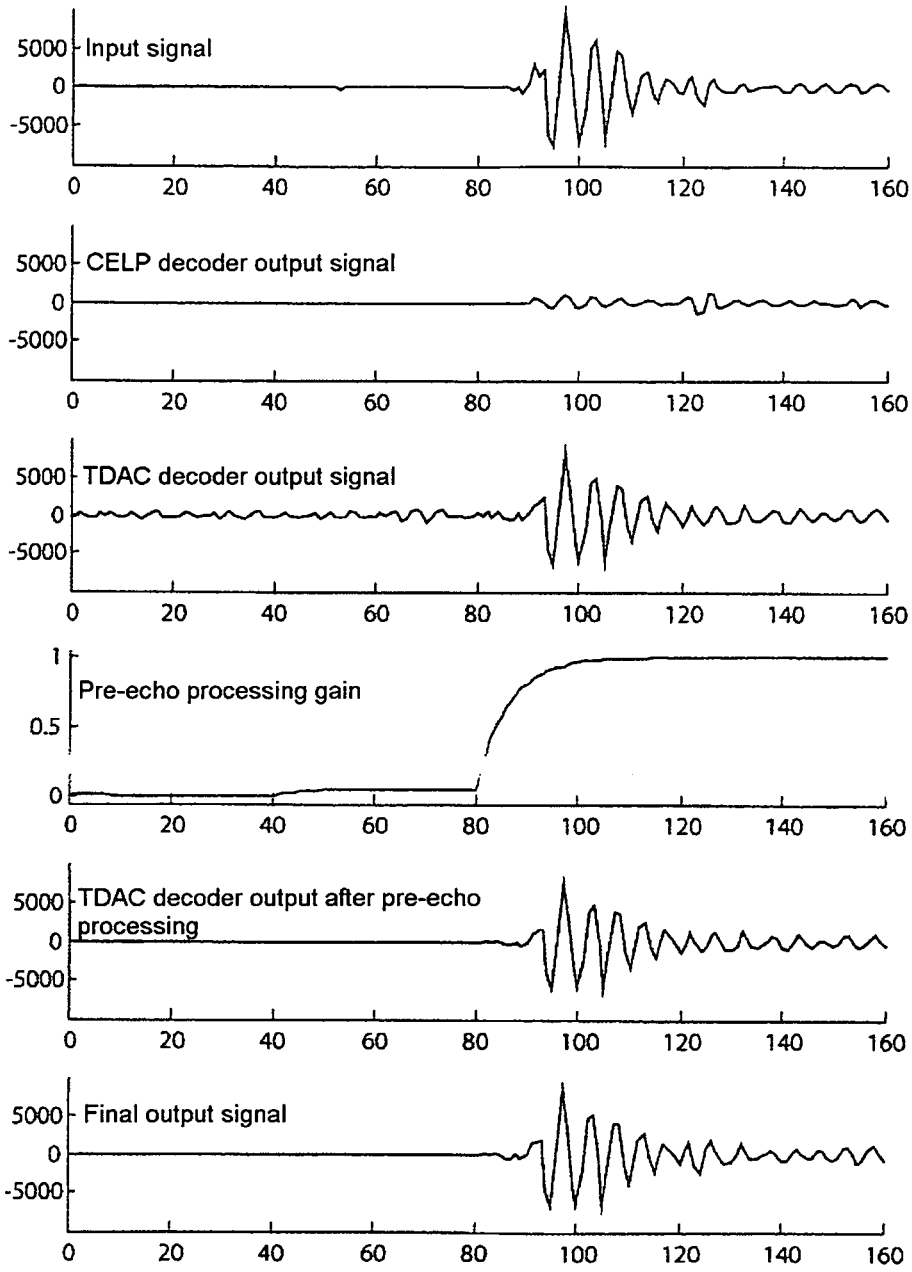
FIG. 3*d* represents a timing diagram of the digital audio signals in a CELP predictive/multi-layer transform encoder of the low band of the signal, in the absence of echo attenuation.

The method and the device that are the subjects of the invention make it possible to remedy the erroneous attenuation of the output of the transform decoding stage or stages of the prior art, as illustrated in FIG. 3*d*. In this figure, the audio outputs are the same as in the preceding figure.

By comparing FIG. 3*c* and FIG. 3*d*, it can be seen that the method that is the subject of the invention makes it possible to inhibit the attenuation of the echo at the moment of the attack (samples 80 to 120) while eliminating the echo before the attack (see pre-echo processing gain). The result of this is that the signal restored at the output of the TDAC decoder after processing of the pre-echoes no longer has echo and that a good restoration of the attack is obtained. The same applies for the final output signal obtained by summing this signal with the output of the CELP decoder and which no longer presents echo.

The echo processing gain generation process is now explained with reference to FIG. 4*a* and FIG. 4*b*.

If there is echo, the energy of a part of the signal in a MDCT window must be significantly greater (attacks) than that of the other parts. The echo is observed in the low-energy parts, so it is necessary to attenuate the echoes only in these parts and not in the high-energy zones.

There are two possible cases: the attack is located either in the current frame or the next frame. In the first case, there is a risk of wrongly attenuating echoes.

Figure 4A:
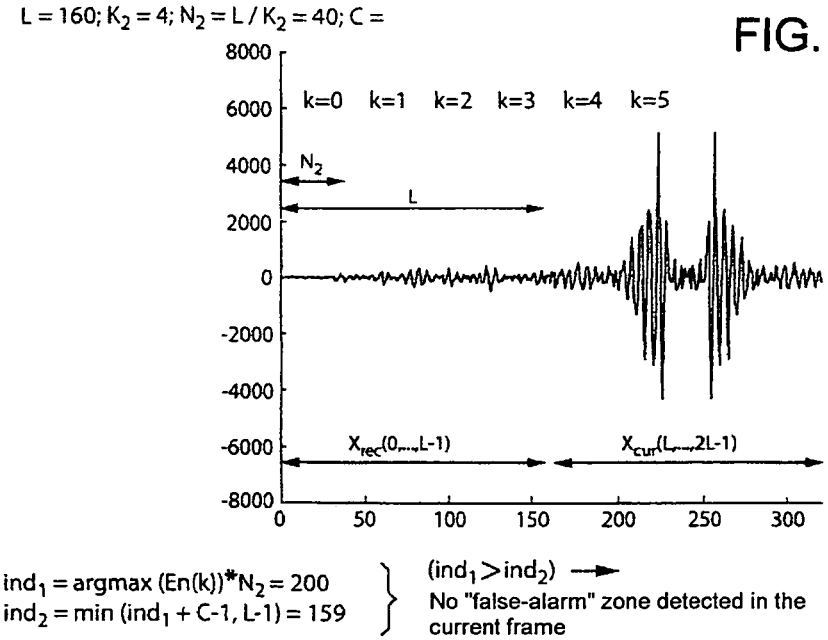
FIG. 4*a* represents, by way of illustration, said concatenated signal, signal controlling the inhibition of echo attenuation according to a first exemplary, preferred, non-limiting implementation of the invention.

FIG. 4*a* represents, with reference to FIG. 2*f*, said concatenated signal for the samples n=0 to 2L−1. For the samples=n=0 to n=L−1 (L=160), it is equal to the reconstructed signal of the current frame, and for the samples n=L to n=2L−1, it is equal to the second part of the current frame. In the next frame, this second part becomes the preceding frame corresponding to the signal $x_{prev}(n+L)$.

The echo attenuation correction process that is the subject of the invention delivers two indices, $ind_1$ and $ind_2$, the start and the end of a possible area in which it is necessary to inhibit the action of the device of the prior art for reducing echoes. $ind_1>ind_2$ signals that there is no such zone in the current frame.

A more detailed description of a non-limiting preferred embodiment of the method that is the subject of the invention will now be given in association with FIGS. 4*a* and 4*b*.

According to the abovementioned embodiment, represented in FIG. 4*a*, the method that is the subject of the invention consists in:

- subdividing the signal of FIG. 4*a* into $2K_2$ sub-blocks of length $N_2=L/K_2$,
- calculating the energy of each of the sub-blocks of length $N_2$ of the signal represented in FIG. 4*a*. It should be noted that, because of the symmetry of the second half of the signal, only the energy of the first 1.5 $K_2$ blocks must be calculated.

It also consists:

- in calculating the index $ind_1$ of the first sample of the maximum energy block, and
- in calculating the minimum energy over the first $K_2$ blocks of the reconstructed signal $x_{rec}(n)$.

When the ratio of the maximum energy to the minimum energy is greater than a threshold value S, there is a risk of pre-echo, but only in the low-energy zone. There is no echo from the high-energy samples.

For an echo detection device of the prior art attenuating the echo, it is necessary to inhibit the attenuation action of the latter on the high-energy samples delimited by the indices $ind_1$ and $ind_2$ defining the zone of the signal containing the high-energy samples and resetting the gain to the value 1. These two indices, the expression of which appears at the bottom of FIG. 4*a*, are determined as follows:

- $ind_1$ is the index of the first sample of the block where the energy maximum occurs,
- $ind_2$ is the minimum between $ind_1+C-1$ and L−1 the index of the end of the block processed. C is the maximum length of the false-alarm zone as a number of samples, set to a value of the order of the duration of a block or more. As an example, a value of C=80 gives good results.

In the example of FIG. 4*a*, there is no inhibition of the echo attenuation, because the attack causing the pre-echo is detected in the next frame, $ind_1$ being greater than $ind_2$. The result of this is that the echo is correctly attenuated over the entire current frame, over the samples from n=0 to 159.

Figure 4B:
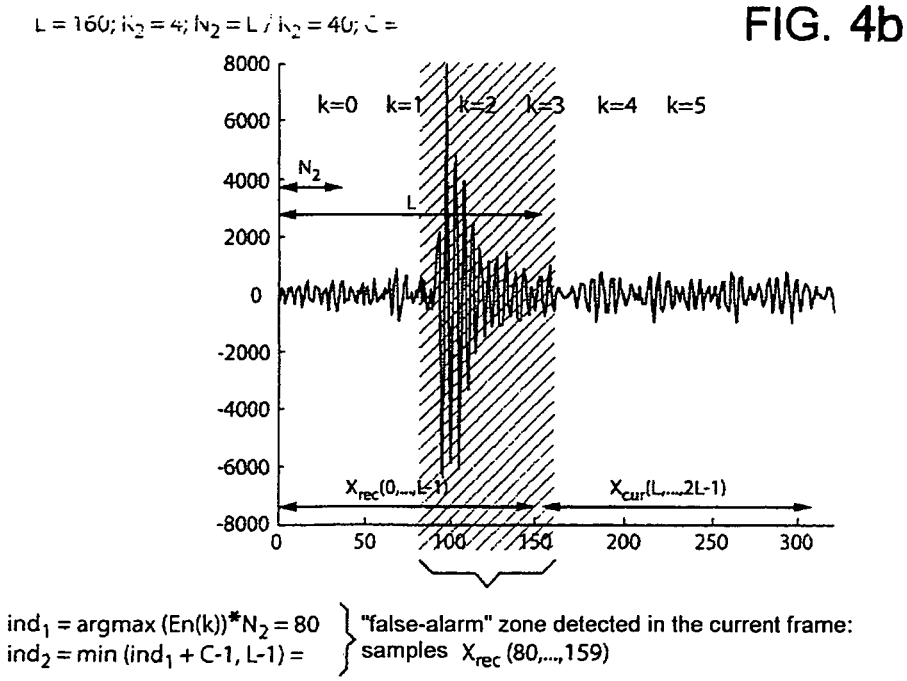
FIG. 4*b* represents, by way of illustration, said concatenated signal, signal controlling the inhibition of the echo attenuation according to a second exemplary, preferred, non-limiting implementation of the invention.

An offset is applied of one signal frame (L=160 samples), as illustrated in FIG. 4*b*, the attack therefore now being located in the current frame.

$$L=160;\ K_2=4;\ N_2=L/K_2=40;\ C=80$$

In this situation, the procedure for calculating the energy maxima and minima described previously is repeated.

It emerges that the energy maximum is found for the block starting at n=80 and that the ratio of the maximum energy to the minimum energy is this time fairly high, not to say greater than the threshold value S. As an example, a value of S=8 gives good results.

In this case, there is a pre-echo before the energy maximum but, on the contrary, the block where the maximum is located and a few subsequent blocks are not subject to the echo phenomenon. In accordance with the method that is the subject of the invention, it is therefore necessary to inhibit the activation of the echo attenuation at the moment of the attack and after. This is what is done for the samples ranging from n=80 to 159 in FIG. 4*b*, the zone contained between the abovementioned samples n=80 to 159 being defined as false-alarm zone.

Consequently, in FIG. 3*d*, a gain (smoothed) is obtained that is practically equal to 1 for the samples from n=80 to 120, the gain attenuation having been inhibited, by a comparison to the same samples in FIG. 3*c*, and the samples from n=80 to n=160 of the signal output from the TDAC decoder after the processing of the pre-echoes, are no longer wrongly attenuated. The result of this is that the final output signal obtained by the summing of this signal with the output signal from the CELP decoder is now correctly restored.

The method that is the subject of the invention can also be implemented in a specific variant for the attenuation of the echoes of a multi-layer encoder of the low or high frequency band for sinusoidal signals, as will be described hereinbelow in association with FIG. 4*c*.

Figure 4C:
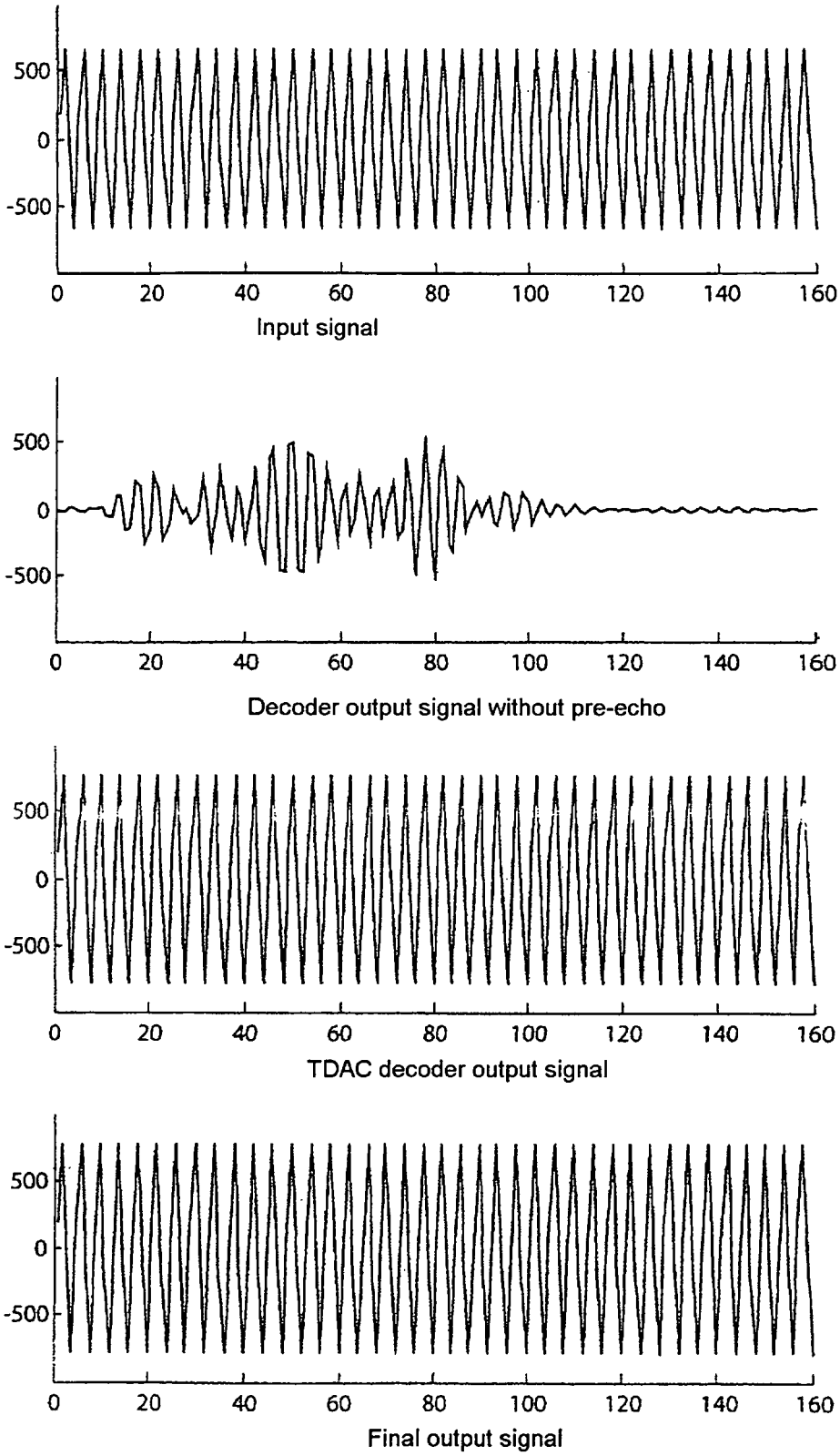
FIG. 4*c* represents a timing diagram of the digital audio signals in a time/multi-layer transform decoder of the high-frequency bands of the signal in the absence of echo attenuation, for the case of decoding of a sinusoid.

FIG. 4*c* shows the audio signals involved in the synthesis of the signal in a time decoder, possibly predictive/multilayer transform of the high band of the audio signal of the type of that described by FIG. 2*a*. The signal to be decoded is a sinusoid. It will be seen that the output of the time decoding stage is degraded compared to the input signal. This is due to the fact that, in the present case, the time decoder operates with a bit rate that is too low to allow the sinusoid to be correctly restored. The output signal from the TDAC decoder is correct. The same applies for the final output signal.

Figure 4D:
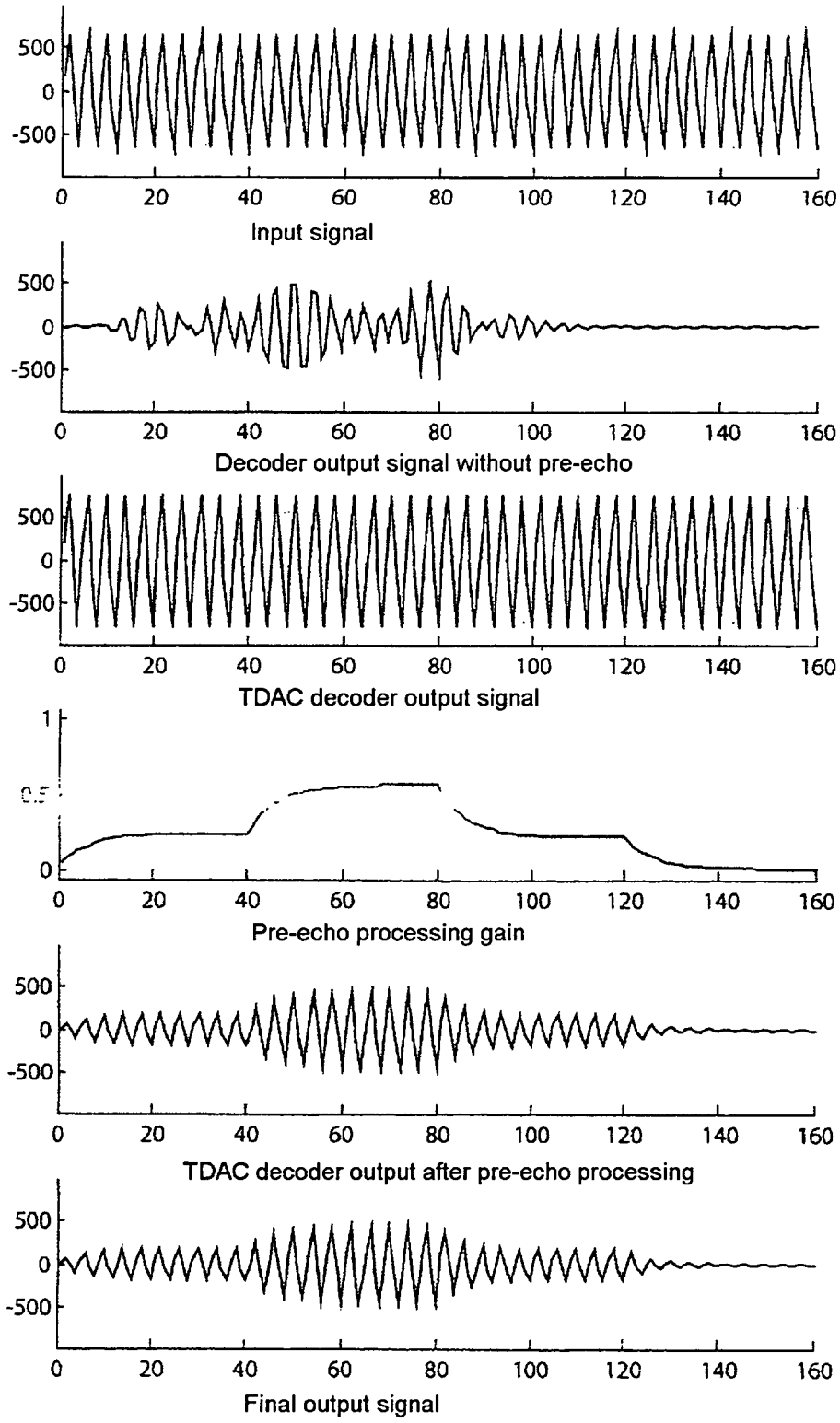
FIG. 4*d* represents a timing diagram of the audio signals in a time/multi-layer transform decoder in the high-frequency band of the signal with activation of the echo attenuation for the decoding of a sinusoid, according to the prior art.

When the echo attenuation process of the prior art, for example that of FIG. 2*a*, is activated, the signals of FIG. 4*d* are obtained. The first three plots represent the same signals as those of FIG. 4*c*. The next three plots represent respectively:

- the echo attenuation gain (rectangle 1 in FIG. 2*b*), of a value between 0 and 1,
- the signal output from the TDAC decoder after processing of the echo. It will be seen that the attenuation of the echoes has been activated, which produces a TDAC stage output signal equal to an amplitude-modulated sinusoid because of the multiplication by the attenuation gain and which does not faithfully reproduce the starting sinusoid,
- the final output signal which represents the same defects as the TDAC decoder output signals, these two signals being identical.

Figure 4E:
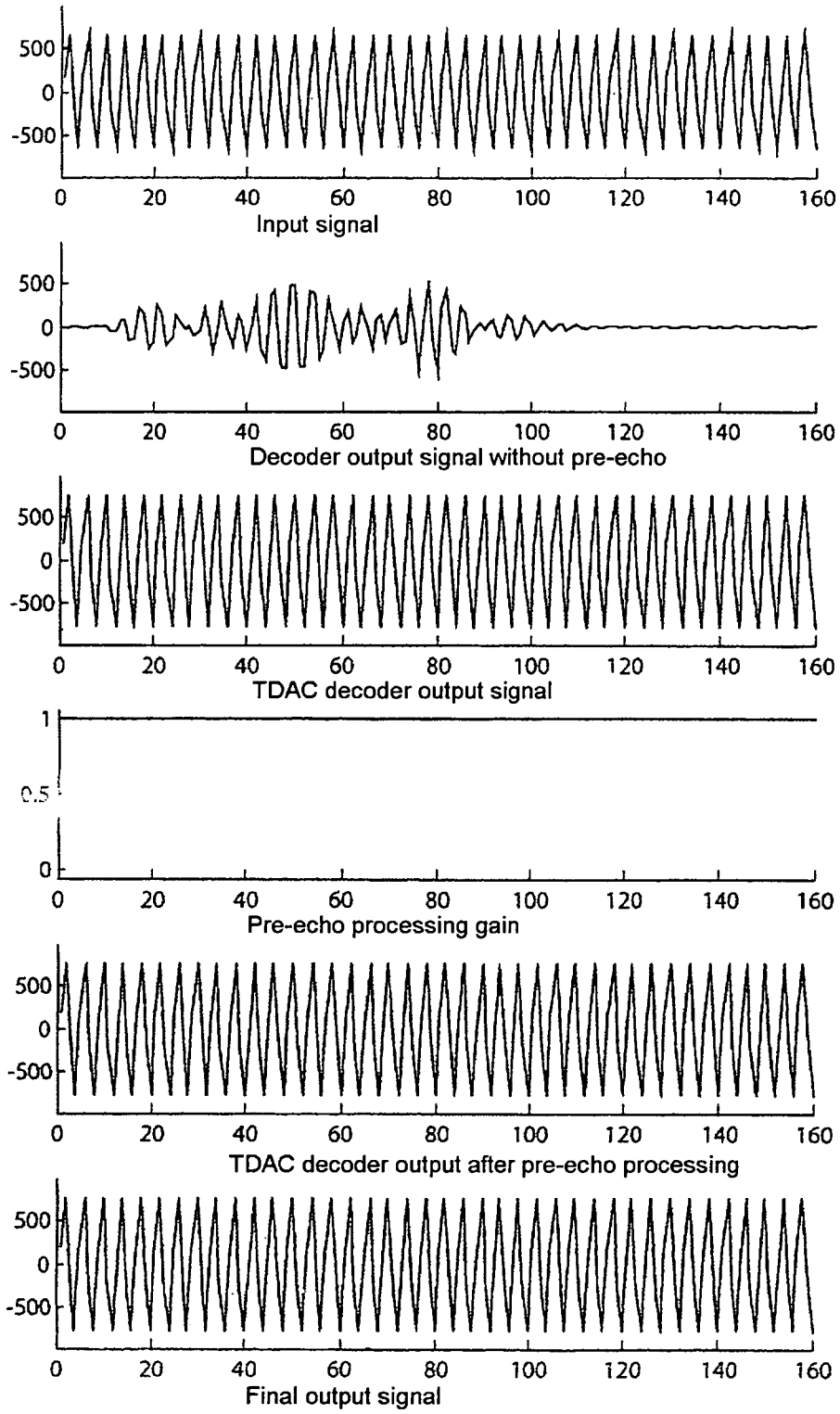
FIG. 4*e* represents a timing diagram of the audio signals in a time/multi-layer transform decoder of the high-frequency band of the signal with activation of the attenuation and of the inhibition of the echo attenuation for the decoding of a sinusoid, according to the method that is the subject of the invention.

The invention makes it possible to remedy the poor modeling of the signal as described in FIG. 4*e*.

The operation of the inhibition of the echo attenuation in the presence of sinusoids will be described with reference to FIG. 5. The procedure for calculating the energy maxima and minima described previously will be taken up again.

It can be seen in the abovementioned figure that there is no maximum net energy. The ratio of the maximum energy to the minimum energy is this time fairly low, less than the threshold value S. This indicates that there is no echo present. According to the method that is the subject of the invention, it is therefore essential to inhibit the activation of the echo attenuator over the entire frame. This is represented for the samples ranging from n=0 to n=159 in FIG. 4*e* where the echo processing gain is equal to 1 for these samples. The signal at the TDAC decoder output after the pre-echo processing is no longer wrongly attenuated. The result of this is that the final output signal identical to this signal is now correctly restored.

Figure 5:
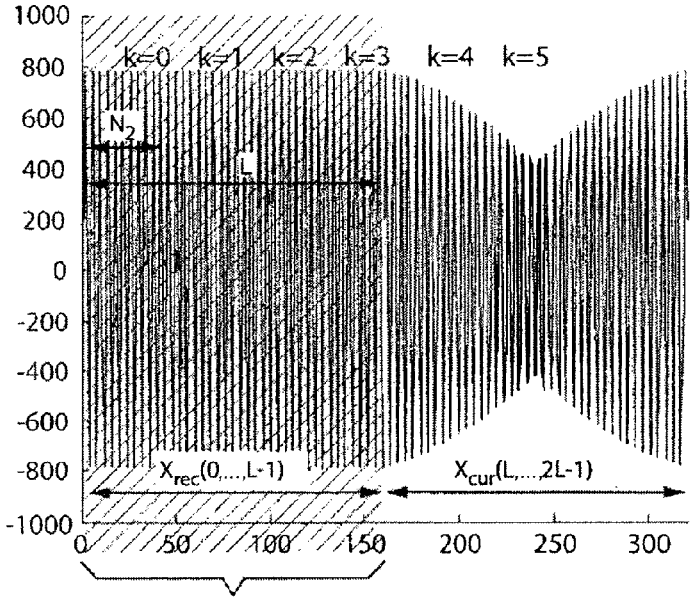
FIG. 5 represents, by way of illustration, said concatenated signal, signal controlling the inhibition of the echo attenuation according to a first exemplary, preferred, non-limiting implementation of the invention.

In FIG. 5:

$$L=160;\ K_2=4;\ N_2=L/K_2=40;\ C=80;\ S=8$$

Figure 6:
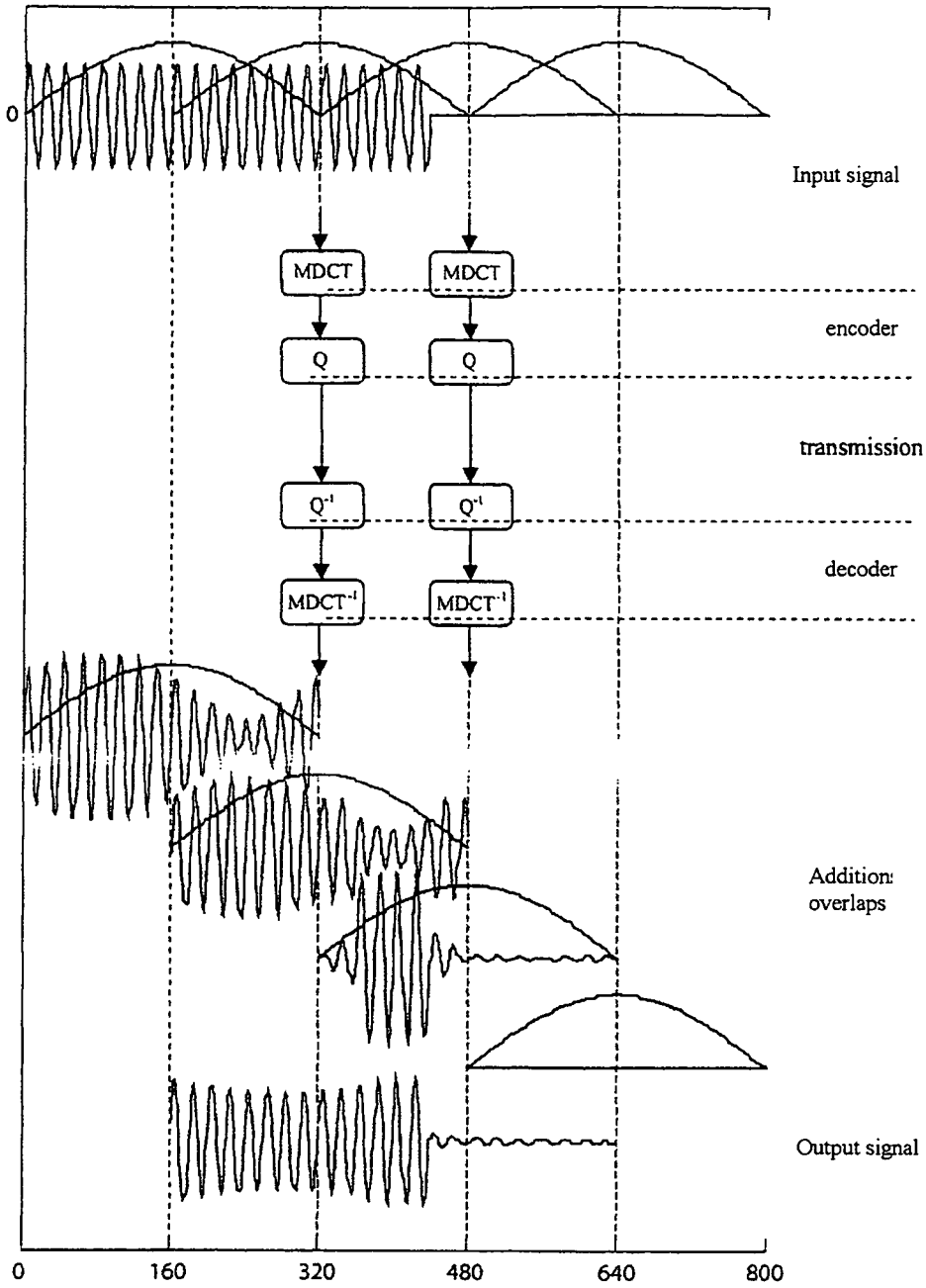
FIG. 6 represents the production of post-echoes in a transform encoding and frame addition/overlap process.

FIG. 6 illustrates the post-echo phenomenon.

Referring to FIG. 6, the post-echo phenomenon can be observed on the output signal in the frame containing the rapid decline of the input signal and in the next frame. In the frame following the strong decline (post-echo zone), it is obviously essential not to inhibit the echo attenuation.

The post-echo situation can be detected by checking the ratio between the maximum energy of the preceding frame and of the current frame. When this ratio is greater than a threshold value, the frame is considered to be a frame originating post-echoes and the echo attenuation algorithm is left to attenuate the echoes of this frame.

A more detailed description of a device for discriminating and attenuating echoes of a digital audio signal generated by a multi-layer hierarchical encoder, according to the subject of the present invention, will now be given in association with FIG. 7.

Figure 7:
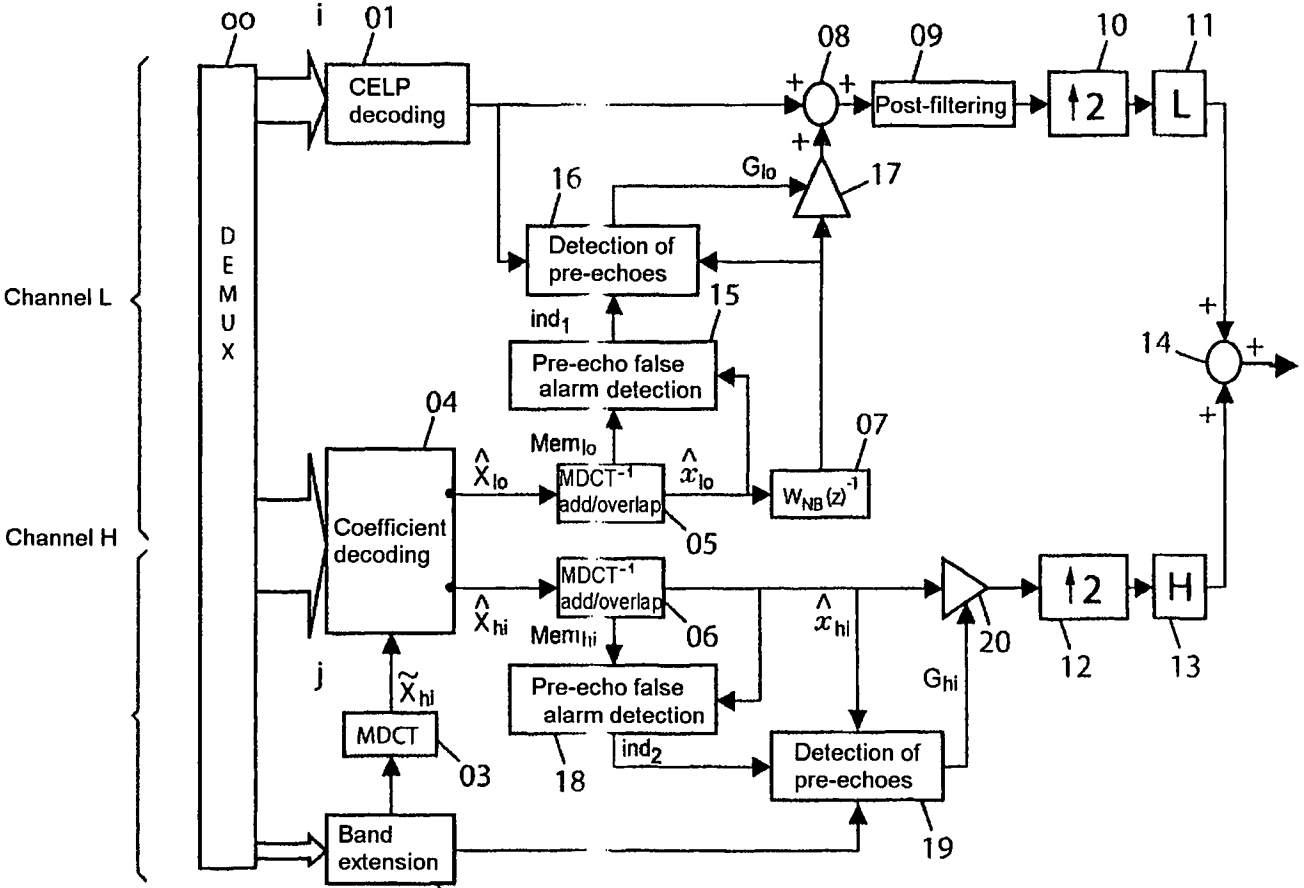
FIG. 7 represents, by way of illustration, a function diagram of a device for discriminating and attenuating the echo of a digital audio signal generated by a multi-layer hierarchical encoder, according to the subject of the present invention, equipped with echo attenuation and echo attenuation inhibition means.

Generally, it will be understood that the device that is the subject of the invention represented in FIG. 7 is incorporated in an echo discrimination device of the prior art, as represented in FIG. 2*b*.

It comprises, in a way similar to the discrimination device of the prior art, a module for calculating the existence of the original position of the echo and the attenuation value receiving, on the one hand, the auxiliary signal $x_{Pi}^{a}(n)$ delivered by the second output of the predictive decoder of rank i of a plurality of predictive decoders and, on the other hand, the decoded signal $x_{Tj}(n)$ delivered by the output of an inverse transform decoder of rank j of the plurality of inverse transform decoders.

Furthermore, in order to ensure that undesirable echoes will be attenuated, it comprises an echo attenuation module receiving the reconstructed signal of the current frame delivered by the inverse transform decoder of rank j and a presence, original echo position and applicable echo attenuation value signal.

Thus, in FIG. 7, a predictive decoder of rank i and a transform decoder, MDCT decoder of rank j, are represented, in a non-limiting way according to the architecture described previously.

A non-limiting preferred embodiment of a device for discriminating and attenuating the echoes of a digital audio signal generated by a multi-layer hierarchical encoder, according to the subject of the present invention, will now be given in association with FIG. 7.

The device that is the subject of the invention as represented in FIG. 7 uses the same architecture as the device of the prior art as represented in FIG. 2*b*, but its specific elements are specified.

In particular, as represented in FIG. 7, the structure for calculating the existence and the original position of echo in at least one low frequency band and/or a high frequency band of the current frame advantageously comprises, connected to a demultiplexer 00 of the device, a low frequency band decoding channel for the digital audio signal, denoted Channel L, and a high frequency band decoding channel for the digital audio signal denoted Channel H.

Furthermore, a summing circuit 14 receives the signal delivered by the high frequency band decoding channel, Channel H, respectively by the low frequency band decoding channel, Channel L, and delivers a reconstituted digital audio signal.

It will be understood in particular from studying FIG. 7 that the high and low channels roughly correspond to the predictive decoder of rank i respectively to the transform decoder of rank j of the prior art structure represented in FIG. 2*b*.

In particular, as represented in FIG. 7, the low frequency band decoding channel, Channel L, advantageously includes a predictive decoding module 01 receiving the demultiplexed digital audio bitstream and delivering a signal decoded by predictive decoding and a transform decoding module 04 receiving the demultiplexed digital audio bitstream and delivering spectral coefficients of the coded difference signal denoted $\hat{X}_{lo}$, in low frequency band.

The low frequency band decoding channel, Channel L, also comprises an inverse transform frequency-time transposition module 05 receiving spectral coefficients of the coded difference signal $\hat{X}_{lo}$, in the low frequency band, and delivers the low frequency band digital audio signal denoted $\hat{x}_{lo}$.

Furthermore, the resources for discriminating the existence of echo in the parts of the low energy signal and the attenuation inhibition resources specific to the low frequency band decoding channel, Channel L, comprise, as represented in FIG. 7, a module for defining a false-alarm zone 15 and a module 16 for detecting echo from the low frequency band digital audio signal $\hat{x}_{lo}$, and from the signal decoded by predictive decoding. The echo detection module 16 delivers a low frequency gain value denoted $G_{lo}$.

Finally, the low frequency band decoding channel, Channel L, comprises a circuit 17 for applying the low frequency gain value $G_{lo}$ to the signal decoded by transform and filtered by $W_{NB}(z)^{-1}$, an addition resource 08, a post filtering resource 09, an oversampling resource 10 and QMF synthesis filtering resource 11, these various elements being cascade-connected and delivering a digital audio low frequency band synthesis signal to the summer 14.

Furthermore, as also represented in FIG. 7, the high frequency band decoding channel, Channel H, advantageously includes a band extension channel 02 receiving the demultiplexed digital audio bitstream and delivering a time reference signal free of pre-echo. This signal serves as a reference for the high frequency band decoding channel and substantially provides the predictive decoding function for the low frequency decoding channel Channel L.

The high frequency band decoding channel Channel H also comprises the transform decoding module 04 which receives the demultiplexed digital audio bitstream and spectral coefficients of the time reference signal via an MDCT transform time-frequency transposition 03, which makes it possible to deliver the spectral coefficients of the time reference signal at the high frequencies, denoted $\hat{X}_{hi}$, to the transform decoding module 04.

The latter delivers the spectral coefficients of the high frequency band encoded digital audio signal denoted $\hat{X}_{hi}$.

The high frequency band decoding channel for the digital audio signal, Channel H, also comprises an inverse transform frequency-time transposition module 06, the inverse transform operation being denoted MDCT-$^{1}$, followed by the addition-overlap operation denoted "add/overlap" receiving the coefficients of the spectrum of the digital audio signal $\hat{X}_{hi}$ in the high frequency band and delivers the high frequency band time digital audio signal denoted $\hat{x}_{hi}$.

In a way similar to the architecture of the low frequency band decoding channel, resources for defining a pre-echo false-alarm zone 18 and for detecting pre-echo 19 forming the echo attenuation inhibition resources are provided. The latter consist of a module 18 for defining a false-alarm zone and for detecting echo 19 from the high frequency band digital audio signal $\hat{x}_{hi}$, and from the signal output from the band extension module, the module for detecting echoes, in particular pre-echoes, 19, delivering a high frequency gain value signal, denoted $G_{hi}$.

Finally, a circuit 20 for applying the high frequency gain value to the high frequency band digital audio signal is provided, followed by an oversampling 12 and high-pass filtering 13 circuit delivering a high frequency band synthesis signal of the digital audio signal to the summing circuit 14.

The operation of the device that is the subject of the invention represented in FIG. 7 is as follows. The bits describing each 20 ms frame are demultiplexed in the demultiplexer 00. The explanation here is for decoding which operates from 8 to 32 bits. In practice, the bitstream has the values of 8, 12, 14, then between 14 and 32 kbit/s, the bit rate can be chosen on request.

The bitstream of the layers at 8 and 12 kbit/s is used by the CELP decoder to generate a first narrow-band synthesis (0-4000 Hz). The portion of the bitstream associated with the layer at 14 kbit/s is decoded by the band extension module 02. The time signal obtained in the high band (4000-7000 Hz) is transformed by the MDCT module 03 into a spectrum $\tilde{X}_{hi}$. The variable part of the received bit rate (14 to 32 kbit/s) controls the decoding of the MDCT coefficients of the low band difference signal and of the high band replacement signal, module for decoding MDCT coefficients 04 which have been encoded in order of perceptual importance. In the low band, the spectrum of the encoded difference signal $\hat{X}_{lo}$ contains the reconstructed spectrum bands and zeros for the non-decoded bands that have not been received on the decoder. In the high band, $\hat{X}_{hi}$ contains the combination of the spectrum deriving from the band extension $\tilde{X}_{hi}$ and spectrum bands of the MDCT coefficients of the high band encoded directly. These two spectra are adjusted to the time domain $\hat{x}_{lo}$ and $\hat{x}_{hi}$ by the inverse MDCT frequency-time transposition and addition/overlap modules 05 and 06.

The modules 15 and 18 determine any zone in which it is essential to inhibit the echo attenuation of the prior art in the reconstructed frame.

As explained previously, the module 15 receives as input signal the reconstructed signal of the current frame $\hat{x}_{lo}$ and the second part of the current frame, designated $Mem_{lo}$ in FIG. 7.

Figure 8A:
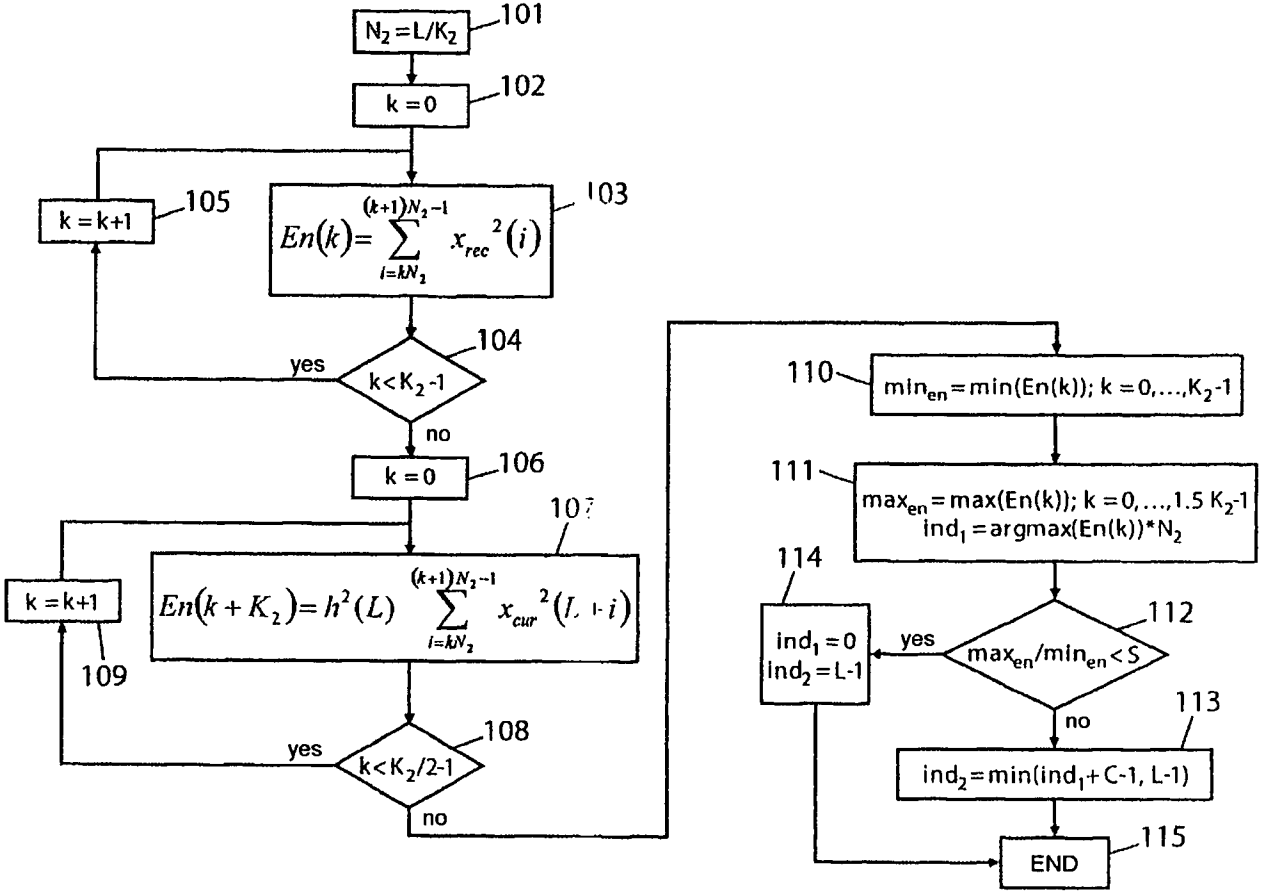
FIG. 8*a* represents, by way of illustration, a flow diagram for calculation of the range of pre-echo attenuation inhibition samples.
Figure 8B:
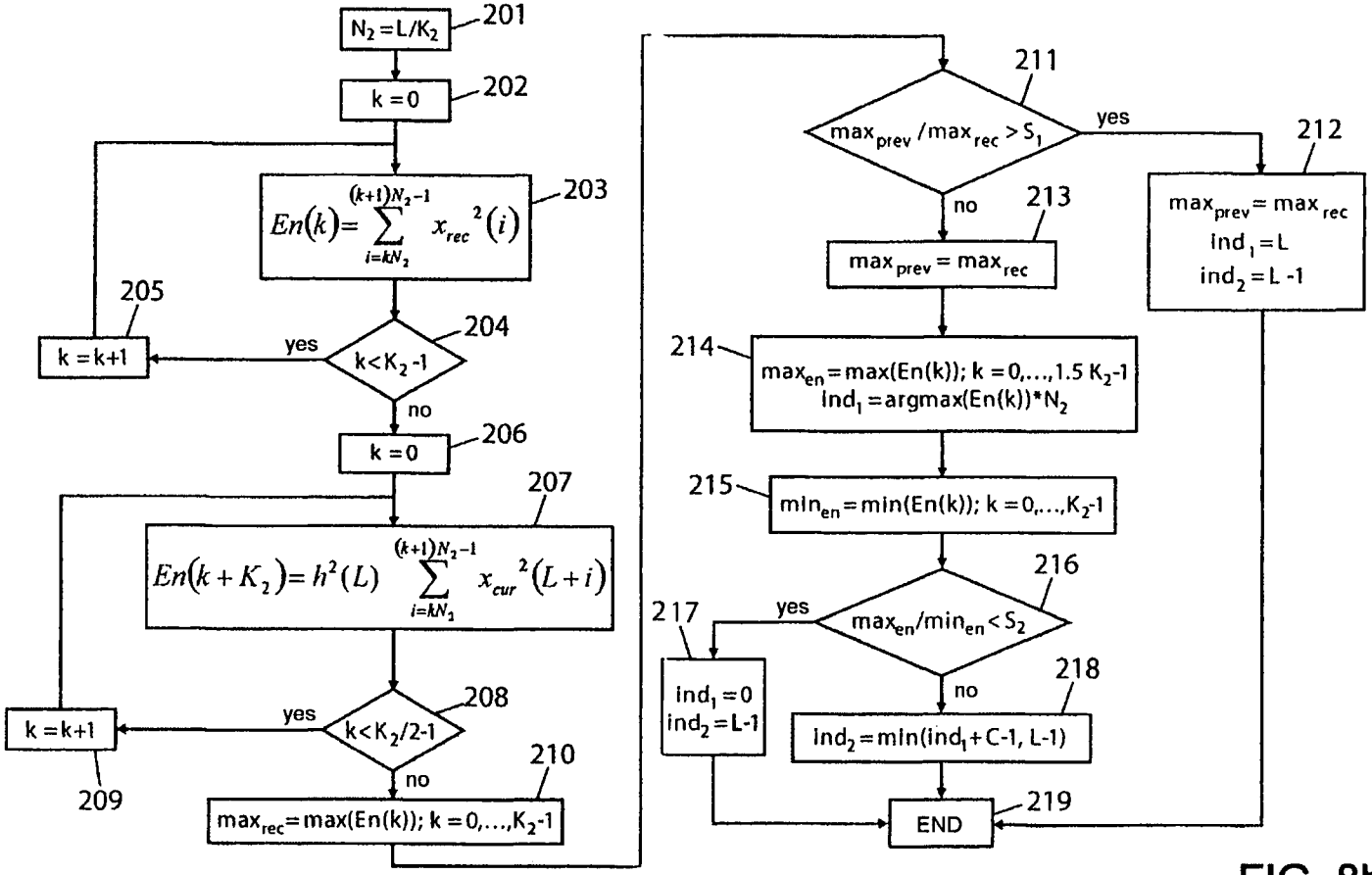
FIG. 8*b* represents, by way of illustration, a timing diagram for calculation of the range of pre-echo and post-echo attenuation inhibition samples.

FIG. 8*a* and FIG. 8*b* show two examples of flow diagrams for the execution of the function of the module 15. The output of the module 15 consists of two indices, defining the start and the end of the zone in which there is no need to apply the echo attenuation and designated false-alarm zone. If these two indices are the same, this means that there is no need to modify the echo attenuation according to the prior art in the current frame.

The block 07 performs the inverse perceptual filtering, of that performed on the encoder, of the output of the inverse transform decoder 05. According to the ratio between the envelope of this signal and that of the output signal of the CELP decoder, the module 16 determines the pre-echo attenuation gains, by also taking into account the indices obtained in the module 15 of the present invention. In the module 16, certain ranges of gain values are reset to 1 and in fact make it possible to inhibit the gain values established according to the prior art, by resetting them to the value 1, a state in which there is no echo attenuation.

Figure 8C:
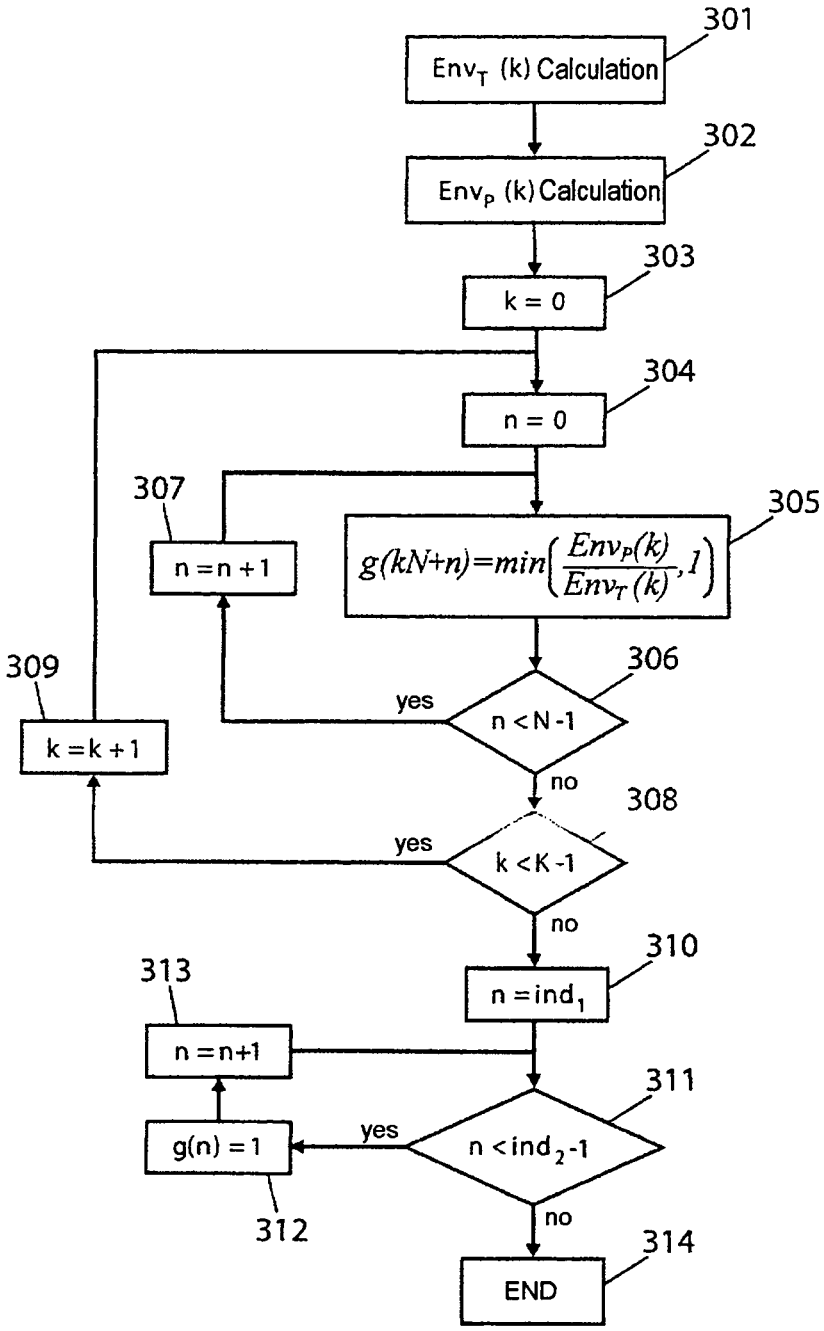
FIG. 8*c* represents, by way of illustration a flow diagram of the implementation of the pre-echo attenuation inhibition.

An exemplary embodiment of the module 16 is given by the flow diagram of FIG. 8*c* which combines the state of the prior art and the correction made according to the present invention, blocks 310 to 313 of FIG. 8*c*. The module 16 also comprises a module for smoothing the gains by low-pass filtering, one exemplary embodiment of which is given in relation to FIG. 8*d*.

The module 17 applies the gain calculated by the module 16 to the output signal of the transform decoder, filtered by the inverse perceptual filter 07, to give a signal with attenuated echo. This signal is then added by a summer 08 to the output signal of the CELP decoder to give a new signal which, post-filtered by the post-filtering module 09, is the reconstituted low-band signal. After over-sampling 10 and transfer to the low-band synthesis QMF filter 11, this signal is added to that of the high band by the summer 14 to give the reconstituted signal.

In the high band, the operation of the module 18 is identical to that of the module 15. From $\hat{x}_{hi}$, the reconstructed signal of the current frame and of the second part of the current frame, designated $Mem_{hi}$ in FIG. 7, the module 18 determines the start and the end of the zone in which the echo attenuation need not be applied.

According to the ratio of the envelope of the output signal of the frequency-time transposition 06 and of the output of the band extension 02, the module 19 determines the pre-echo attenuation gains, by also taking into account the indices obtained by the module 18, flow diagrams of FIG. 8*a* and FIG. 8*b*, for which the gains are set to a value 1 according to the invention, FIG. 8*c*. The gains obtained are then smoothed by low-pass filtering, FIG. 8*d*. The module 20 applies the gain calculated by the module 19 to the combined signal $\hat{x}_{hi}$ of the output of the frequency-time transposition 06.

The wideband output signal, sampled at 16 kHz, is obtained by adding 14 signals from the low band synthesized by over-sampling 10 and low-pass filtering 11 and from the high band also synthesized by over-sampling 12 and high-pass filtering 13.

The operation of the echo attenuation inhibition performed by the modules 15 and 18 of FIG. 7 is described in association with the flow diagram of FIG. 8*a*, referring to the explanations relating to FIG. 4*a*, FIG. 4*b* and FIG. 4*c*.

The first part of the flow diagram around the step referenced 103 consists in calculating the energy of the $K_2$ sub-blocks the reconstructed signal $x_{rec}(n)$ after addition/overlap. $x_{rec}(n)$ in this flow diagram corresponds respectively to the signals $\hat{x}_{lo}$ and $\hat{x}_{hi}$ of FIG. 7.

The next part around the step referenced 107 consists in calculating the energy of each sub-block of the second part of the current frame, at the output of the inverse MDCT. Only $K_2/2$ values are different because of the symmetry of this part of the signal.

The energy minimum $min_{en}$ is calculated on the $K_2$ sub-blocks of the reconstructed signal, step 110. The maximum of the energies of the signal sub-blocks $x_{rec}(n)$ and $x_{cur}(n)$ is calculated in step 111 over the $K_2+K_2/2$ blocks.

The last part of the flow diagram represented in FIG. 8*a* consists in calculating the indices $ind_1$ and $ind_2$ which make it possible to reset the echo attenuation gain to the value 1, the gain attenuation of the prior art thus being inhibited. For this, the ratio of the maximum energy to the minimum energy is calculated and it is compared to a threshold value S in the step 112. If the ratio is less than the threshold value S, then $ind_1$ is set to 0 and $ind_2$ is set to L−1, that is, the gain is subsequently reset to 1 throughout the current frame, over a range n=0 to n=L−1. In practice, the difference between the energies is low and there is therefore no attack. Otherwise, $ind_2$ is instantiated with the value $ind_1$+C−1, C being a determined number of samples. A range of samples is thus selected over which the gain is reset to 1, by provoking the inhibition of the echo gain attenuation over this range of samples where the attack lies. If the value $ind_2$ exceeds the frame length (L), it is set to L−1; $ind_2$ points to the last sample of the frame.

The procedure according to the flow diagram of FIG. 8*a* wrongly inhibits the post-echo attenuation. In the case of a post-echo, the attack lies in the preceding frame whereas in the current frame and the next frame the energy can be fairly uniform. Furthermore, this energy generally decreases. For one of these two reasons, a false alarm is wrongly detected by the procedure of FIG. 8*a*.

To keep the post-echo attenuation processing intact, a modification is applied to the procedure represented in FIG. 8*a*. The modified flow diagram for calculation of the range of samples for inhibiting the attenuation of the pre- and post-echoes, is then described in the modified procedure with reference to FIG. 8*b*.

The first part of the flow diagram of FIG. 8*b* as far as the step referenced 208 is similar to the part of the flow diagram of FIG. 8*a* as far as the step referenced 108 in the latter.

The next part also takes into account the post-echo cases in which there is no need to inhibit the activation of the post-echo gain attenuation.

$max_{rec}$, the energy maximum over the $K_2$ blocks of the reconstituted signal, is first calculated in the step 210. Having kept in memory the energy maximum from the preceding frame $max_{prev}$, the ratio of $max_{prev}$ to the current maximum $max_{rec}$ is then compared. When the ratio is greater than a threshold value $S_1$, there is a post-echo situation and the post-echo attenuation must not be inhibited. Consequently, $max_{rec}$ is stored for the next frame and instantiated $ind_1$ with L and $ind_2$ with L−1, step 212, and the procedure is terminated. Otherwise, $max_{rec}$ is stored for the next frame in the step 213. $max_{en}$, the energy maximum over all of the 1.5 $K_2$ blocks of the concatenated signal and the start index of the maximum energy block is then calculated, step 214. The minimum energy is then calculated, then the ratio of the energy maximum to the minimum is compared in a way similar to the flow diagram of FIG. 8*a*, steps 112, 113, 114 and 115. In the case where the ratio is less than the threshold value, $ind_1$ is set to 0 and $ind_2$ to L−1, that is, the echo attenuation is inhibited by setting the gain to 1 over the range of samples from 0 to L−1, or over the entire frame. In the contrary case, $ind_2$ is assigned the value $ind_1$+C−1, C being a fixed number of samples, the gain is then instantiated with the value 1 over the range of samples from $ind_1$ to $ind_2$. If the value of $ind_2$ exceeds the length of the frame (L), it is instantiated with L−1, $ind_2$ then points to the last sample of the frame.

The inhibition of the echo attenuation across the false-alarm range will now be described in association with FIG. 8*c*. The flow diagram of FIG. 8*c* repeats, in the first part, the flow diagram of FIG. 2*d* of the prior art for the calculation of the echo attenuation.

The steps 301 for calculating the envelope of the signal deriving from the transform encoder and 302 for calculating the envelope of the signal deriving from the time encoder have been added at the start of the flow diagram. Then, the essential part that has been added to FIG. 8*c* compared to FIG. 2*d* relates to the steps 310 to 314 of FIG. 8*c*. This part concerns the setting of the echo attenuation gain to the value 1, between the samples $ind_1$ and $ind_2$. According to the method that is the subject of the invention, the range $ind_1$ to $ind_2$ has been determined as the range of samples in which the activation of the echo attenuation of the prior art operates wrongly and must therefore be modified as described previously.

For the implementation of the method illustrated by FIG. 8*c*, in fact, the initial gain factor g(n) is smoothed on each sample of the signal by a first order recursive filter to avoid the discontinuities. The transfer function of the smoothing filter is given by:

$$g(z) = \frac{\alpha}{1 - \alpha z^{-1}}$$

Hence, the filtering equation in the time domain:

$$g'(n)=\alpha g'(n-1)+(1-\alpha)g(n)$$

In the preceding relations $\alpha$ is a real value between 0 and 1.

Figure 8D:
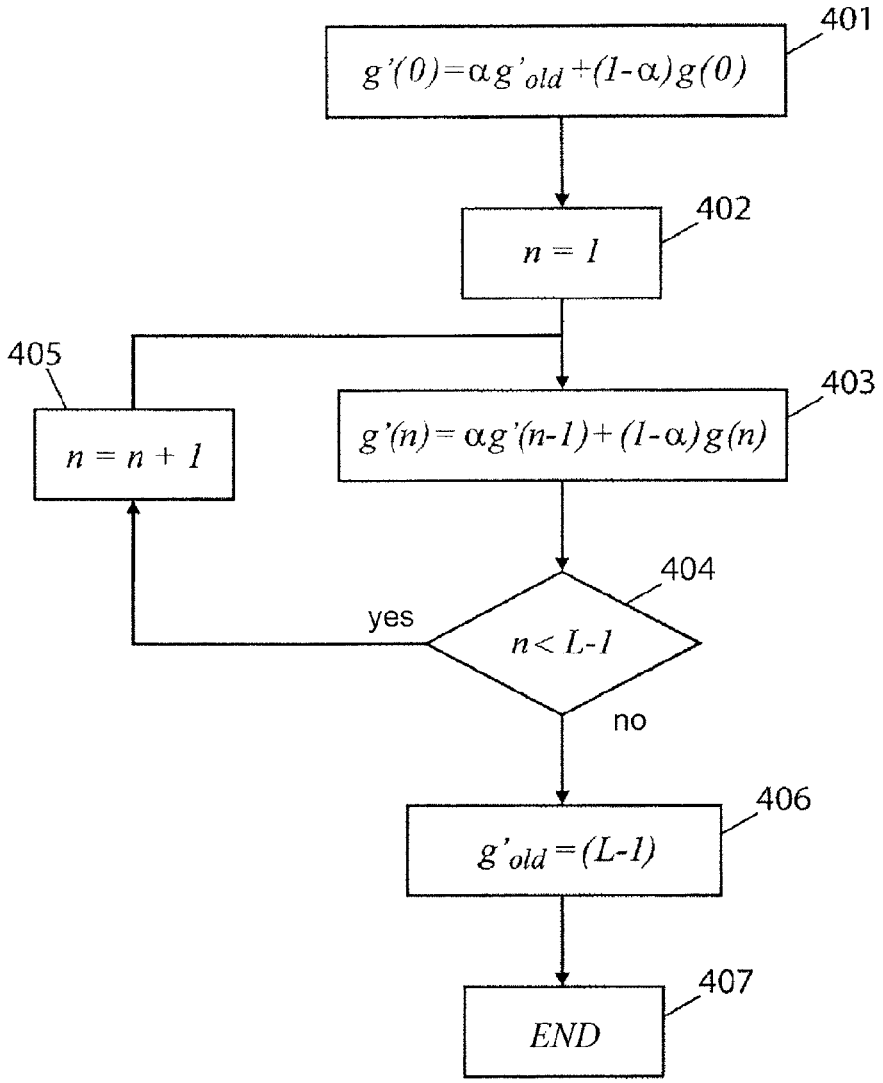
FIG. 8*d* represents, by way of illustration, a gain factor smoothing flow diagram.

In practice, this initial gain is calculated every $k_2$ samples (typically $k_2$=40) and its value is repeated for all the samples of the sub-block, which gives it a staircase appearance, hence the use of the smoothing described by the flow diagram of FIG. 8*d*. The smoothing of the echo attenuation gain appears clearly, by way of example, in FIG. 3*d* with a gentle rise in the gain from a low value to the value 1.

It can be noted that the modules for defining a false-alarm area 15 and/or 18 operate with the only input signals being the signals deriving from the inverse transform for the addition/overlap. This module can be implemented in any decoder (hierarchical or not, multi-band or not) using an inverse transform by addition/overlap to generate the reconstructed signal to secure the initial echo attenuation decision given by another device.

Figure 9A:
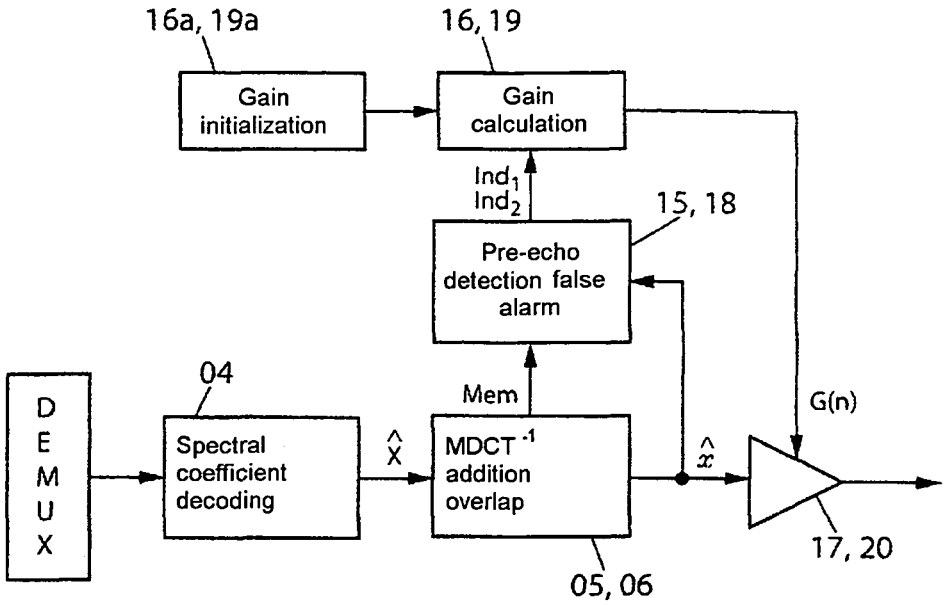
FIG. 9*a* represents, by way of illustration, a block diagram of a module for defining a false-alarm zone.

An exemplary implementation is illustrated by FIG. 9*a* hereinbelow. The initiation of the gains can come from any other method of calculating echo attenuation gain.

In FIG. 9*a*, the double references 05, 06; 15, 18; 16*a*, 19*a* and 17, 20 in fact designate the corresponding elements of FIG. 7, for the module for defining a false-alarm zone 15, respectively 18. Furthermore, a gain initialization sub-module 16*a*, 19*a* is added.

Figure 9B:
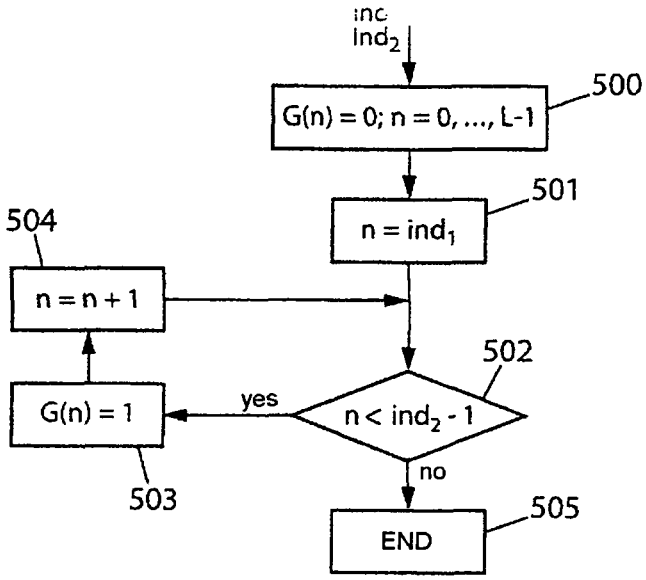
FIG. 9*b* represents, by way of illustration, a flow diagram for calculation of the gains in the gain calculation sub-module of FIG. 9*a*.

An exemplary implementation of the calculation of the initial gains is given with reference to FIG. 9*b* hereinbelow. In this case, the gains are initially set to zero and the echo attenuation inhibition procedure is used to reset the gain to 1 in all the zones where the echo is not present.

The corresponding substeps comprise, as much for the module for defining a false-alarm zone 15 as 18, a sub-step 500 for initializing the gain G(n) of the rank of the sample n with the value zero, a step 501 for instantiating the rank of the sample being processed n with the first index value $ind_1$, a test step 502, for comparing the inferiority of the rank n to the second index value minus 1.

As long as this value is not reached, the gain value G(n) is modified to the value 1, 503, and the method goes on to the next rank sample 504, by n=n+1, the substep 502 the gain modification operation is terminated.

The method that is the subject of the invention uses a particular example of calculation of the start of the attack (search for the energy maximum for each sub-block) that can operate with any other method of determining the start of the attack.

The method that is the subject of the invention and the abovementioned variant apply to the attenuation of the echoes in any transform encoder that uses a bank of MDCT filters or any bank of filters with perfect reconstruction with real or complex value, or the banks of filters with almost perfect reconstruction and the banks of filters that use the Fourier transform or wavelet transform.

The invention also covers a computer program comprising a series of instructions stored on a medium for execution by a computer or a dedicated device, noteworthy in that, on execution of these instructions, the latter executes the method that is the subject of the invention, as described previously in association with FIGS. 3*a* to 5*b*.

The abovementioned computer program is a directly executable program installed in a module for discriminating the existence of echoes in the low-energy signal parts, an echo attenuation module and a module for inhibiting the attenuation of the echo in the high energy parts of the signal of the current frame, of an echo attenuation detection device as described in association with FIGS. 7 to 8*d*.

The invention claimed is:

1. A method for discriminating and attenuating the echoes of a digital audio signal generated from a transform encoding stage, which generates echoes, wherein the encoding also comprises, in parallel with the transform encoding stage, which generates echoes, a time encoding stage, which does not generate echoes, the method including at least in the decoding, for each current frame of this digital audio signal, the following steps:

discriminating a low-energy zone of the current frame preceding a transition to a high-energy zone of the current frame;

defining a false-alarm zone corresponding to the non-discriminated zones of the current frame;

determining an initial processing of the echoes with attenuation gain values of the current frame;

attenuating the echoes according to the initial processing of the echoes in said low-energy discriminated zones of the current frame;

inhibiting the attenuation of the echoes in the initial processing in the false-alarm zone;

wherein said determination of the initial processing of the echoes comprises, in the decoding, for each current frame of this digital audio signal:

comparing, in real time, in at least one frequency band, a value representative of a variable obtained from a characteristic of the time envelope of the signal obtained from an echo-generating decoding and of a variable obtained from the corresponding characteristic of the signal obtained from a non-echo-generating decoding to a threshold value; and according to the result of this comparison, concluding on the existence or the non-existence of an echo obtained from the transform encoding in the current frame;

and, if an echo exists, determining the initial attenuation gain values of the echoes according to said variables obtained from said echo-generating decoding and from said non-echo- generating decoding.

2. The method as claimed in claim 1, wherein a current frame comprising a first and a second part, the step which consists in defining the false-alarm zone comprises at least the following steps:

generating a concatenated signal, from the reconstructed signal of the current frame and from the signal of the second part of the current frame;

dividing up said concatenated signal into an even number of sub-blocks of samples of determined length;

calculating the energy of the signal of each of the sub-blocks of determined length;

calculating the maximum of the energy values of all the sub-blocks;

calculating the minimum of the energy values on the sub-blocks of the reconstructed signal of the current frame; and when the ratio of the maximum energy to the minimum energy is less than or equal to a determined threshold value, the absence of echo being revealed in all of the current frame, assigning the rank of the first sample of the current frame to a first index and assigning the rank of the last sample of the current frame to a second index;

identifying as said false-alarm zone the samples of the current frame included between said first and second indices.

3. The method as claimed in claim 2, wherein when said ratio of the maximum energy to the minimum energy is greater than said determined threshold value, a risk of pre-echoes being revealed in the only low-energy part of the signal, said method also comprises a step for calculating a first index representative of the rank of the first sample of the high-energy zone and a second index representative of the rank of the last sample of the high-energy zone.

4. The method as claimed in claim 3, wherein said first index is the index of the first sample of the first high-energy sub-block.

5. The method as claimed in claim 2, wherein said second index is calculated as the minimum between the value of the first index augmented by the maximum false-alarm length in terms of number of samples minus 1 and the value of the index of the end sample of the current frame being processed minus 1.

6. The method as claimed in claim 1 in which said inhibition is performed by setting the attenuation gain values to the value 1 in said false-alarm zone while keeping the initial gain values outside the false-alarm zones, and applying the resultant attenuation gain values to the samples of the reconstructed signal of the current frame.

7. The method as claimed in claim 6, wherein said resultant gain values are smoothed by filtering before being applied to the samples of the reconstructed signal of the current frame.

8. The method as claimed in claim 1, wherein the ratio of the maximum energy of the preceding frame is stored, and when the ratio of the energy of the preceding frame to the energy of the current frame is greater than a determined threshold value, a risk of post-echoes being revealed in the current frame, said method also consists in attenuating the echoes according to the initial processing of the echoes in the current frame.

9. A non-transitory computer-readable storage medium, with a program stored thereon, wherein the program comprises a series of instructions to implement the method of discriminating and attenuating the echoes of a digital audio signal as claimed in claim 1.

10. A device for discriminating and attenuating the echoes of a digital audio signal generated by a multilayer hierarchical encoder, in a decoder, said decoder comprising at least one time decoder, which does not generate echoes, and at least one transform decoder, which can reveal echoes, wherein said device comprises, at least on a transform decoder:

means of discriminating a low energy zone of a current frame preceding a transition to a high-energy zone of the current frame;

means of defining a false-alarm zone corresponding to the non-discriminated zones of the current frame;

means of determining an initial processing of the echoes with attenuation gain values;

means of attenuating the echoes according to the initial processing of the echoes applied to said low-energy discriminated zones of the current frame;

means of inhibiting the attenuation of the echoes of the initial processing applied to the false-alarm zone;

wherein means of determining an initial processing are further arranged for:

comparing, in real time, in at least one frequency band, a value representative of a variable obtained from a characteristic of the time envelope of the signal obtained from an echo-generating decoding and of a variable obtained from the corresponding characteristic of the signal obtained from a non-echo-generating decoding to a threshold value; and according to the result of this comparison, concluding on the existence or the non-existence of an echo obtained from the transform encoding in the current frame;

and, if an echo exists, determining the initial attenuation gain values of the echoes according to said variables obtained from said echo-generating decoding and from said non-echo- generating decoding.

11. The device as claimed in claim 10, wherein, for a digital audio signal generated by a multilayer hierarchical encoder, in a decoder, said decoder comprising at least one time decoder, which does not generate echoes, and at least one transform decoder, which can reveal echoes, said device comprises at least on a time decoder and a transform decoder:

a means of discriminating the low-energy zone preceding a transition to a high-energy zone delivering indices of the zone in which the attenuation of the echoes must be inhibited;

a means of calculating the existence and the original position of echo in at least one frequency band of the current frame, receiving at least said indices of the zone in which the attenuation of the echoes must be inhibited and delivering echo attenuation values applicable in the current frame;

means of attenuating the echo receiving said decoded signal of the current frame, delivered by said inverse transform decoder and said echo attenuation values applicable in the current frame.

12. The device as claimed in claim 10, wherein said means of calculating the existence and the original position of echo in at least one low frequency band and one high frequency band of the current frame is integrated and comprises, connected to a demultiplexer of said decoder:

a low-frequency band decoding channel for the digital audio signal;

a high-frequency band decoding channel for the digital audio signal;

a summing circuit receiving the signal delivered by the high-frequency band decoding channel respectively by the low-frequency band decoding channel, and delivering a reconstructed digital audio signal.

13. The device of claim 11 further comprising a non-transitory computer-readable storage medium with a program stored thereon, wherein the program comprises a series of instructions which cause the device to implement the method of discriminating and attenuating the echoes of a digital audio signal of claim 1.

* * * * *